US007182037B2

(12) United States Patent
Otobe et al.

(10) Patent No.: US 7,182,037 B2
(45) Date of Patent: Feb. 27, 2007

(54) MARINE PROPULSION ATTACHMENT WITH REMOVABLE FRAME STRUCTURE FOR NON-SELF-PROPELLED MARINE VEHICLES

(75) Inventors: Taiichi Otobe, Wako (JP); Toyokazu Kawasaki, Wako (JP); Haruhiko Ohkawa, Wako (JP)

(73) Assignee: Honda Motor Co., Ltd. (JP)

( * ) Notice: Subject to any disclaimer, the term of this patent is extended or adjusted under 35 U.S.C. 154(b) by 0 days.

(21) Appl. No.: 11/092,788

(22) Filed: Mar. 29, 2005

(65) Prior Publication Data

US 2005/0217555 A1 Oct. 6, 2005

(30) Foreign Application Priority Data

Mar. 30, 2004 (JP) ..... 2004-101495
Mar. 30, 2004 (JP) ..... 2004-101504
Mar. 30, 2004 (JP) ..... 2004-101531

(51) Int. Cl.
*B63B 17/00* (2006.01)

(52) U.S. Cl. ..... 114/343; 441/74

(58) Field of Classification Search ..... 114/343, 114/345, 347, 364, 352; 441/74
See application file for complete search history.

(56) References Cited

U.S. PATENT DOCUMENTS 3,694,835 A * 10/1972 Casey et al. ..... 114/345
3,918,666 A 11/1975 Florian ..... 248/4
4,371,144 A * 2/1983 Godlewski ..... 114/343
4,752,261 A * 6/1988 Rosello Zoya ..... 441/74
5,715,876 A * 2/1998 Burt ..... 114/343
6,035,799 A * 3/2000 Lukanovich et al. ..... 114/343
6,490,989 B1 * 12/2002 Ray ..... 114/345

FOREIGN PATENT DOCUMENTS

JP 0195499 6/1989

* cited by examiner

*Primary Examiner*—Lars A. Olson
(74) *Attorney, Agent, or Firm*—Adams & Wilks

(57) ABSTRACT

A removable marine propulsion attachment for a non-self-propelled marine vehicle includes a frame structure and a propulsion unit removably mounted on a transom board disposed at the rear end of a body of the frame structure. The frame structure also includes a handle disposed at the front end of the frame body for holding by a person riding on the marine vehicle, and connecting devices provided on the frame body for removably connecting the frame body to the marine vehicle.

15 Claims, 31 Drawing Sheets

MARINE PROPULSION ATTACHMENT WITH REMOVABLE FRAME STRUCTURE FOR NON-SELF-PROPELLED MARINE VEHICLES

FIELD OF THE INVENTION

The present invention relates to a removable frame structure used for attachment of a propulsion unit to a non-self-propelled marine vehicle, a marine propulsion attachment including such removable frame structure and a propulsion unit mounted thereon, and a removable handle for use with the non-self-propelled marine vehicle.

BACKGROUND OF THE INVENTION

The term "non-self-propelled marine vehicle" is used herein to broadly refer to marine vehicles, such as small rowboats, canoes, kayaks, inflatable boats, surfboards, or wind-surfboards, which are not equipped with a propulsion unit such as an outboard motor for self-propelling of the marine vehicle, or which do not have a transom for mounting an outboard motor.

Propulsion attachments removably mounted on a non-self-propelled marine vehicle for propelling the marine vehicle are known as disclosed, for example, in U.S. Pat. No. 3,918,666.

The disclosed propulsion attachment includes a bracket for mounting an outboard motor to a canoe. The bracket comprises a hollow frame of generally triangular configuration, a plurality of cup-shaped members mounted on the frame and directed to engage sides and top deck of the canoe, and a vertical motor support fixed to L-shaped arms at an apex of the triangular frame. For operation, the bracket is fitted over a rear end of the canoe so that the cup-shaped members engage the sides and top deck of the canoe until a proper tight fit is secured between the cup-shaped member and the canoe. Then, an outboard motor is mounted on the vertical motor support.

The propulsion attachment of the foregoing construction is intended for exclusive use with a canoe and cannot be used with surfboards because the surfboards are relatively thin and have no side walls large enough to permit fitting engagement with the cup-shaped members to secure attachment of the bracket to the surfboards.

Surfing (also called "surfriding") is the sport of riding in toward shore on the crest of a wave on a surfboard while balancing the buoyancy (or lift) and the gravity acting on the surfboard. Surfboards used in the sport of surfing normally have no propulsion unit, however, self-propelled surfboards, i.e., surfboard equipped with a propulsion unit are also known as disclosed, for example, in Japanese Utility Model Laid-open Publication (JP-UM-A) No. 01-95499.

The disclosed self-propelled surfboard comprises a surfboard body, an engine mounted inside the surfboard body, and a water jet screw propeller disposed at a rear end of the surfboard body and driven by the engine for propelling the surfboard. The engine-driven surfboard is very large in size, heavy in weight and expensive, so that a person riding on this surfboard cannot enjoy a dynamic riding feel or pleasure that can be obtained when using a normal non-self-propelled surfboard.

It is therefore an object of the present invention to provide a frame structure, which is removably mounted on a non-self-propelled marine vehicle for the purpose of attaching a propulsion unit to the non-self-propelled marine vehicle to thereby expand use or application of the marine vehicle.

Another object of the present invention is to provide a removable frame structure, which is used for attachment of a propulsion unit to a non-self-propelled marine vehicle, and which is highly convenient for storage and transportation.

A further object of the present invention is to provide a removable marine propulsion attachment including the foregoing frame structure and a propulsion unit removably mounted on the frame structure.

Still another object of the present invention is to provide a handle, which can be readily attached to or detached from a non-self-propelled vehicle for holding by a person riding on the marine vehicle.

SUMMARY OF THE INVENTION

According to a first aspect of the present invention, there is provided a frame structure for attachment of a propulsion unit to a non-self-propelled marine vehicle, comprising a frame body having a front end and a rear end, a handle disposed at the front end of the frame body for holding by a person riding on the marine vehicle, a substantially vertical transom board disposed at the rear end of the frame body for attachment of the propulsion unit to the frame structure, and connecting means on the frame body for removably connecting the frame body to the marine vehicle.

The frame structure of the foregoing construction can be readily attached to or detached from the non-self-propelled marine vehicle according to an intended use of the marine vehicle.

According to a second aspect of the present invention, there is provided a removable marine propulsion attachment for a non-self-propelled marine vehicle, comprising the aforementioned frame structure, and a propulsion unit removably mounted on the transom board of the frame structure. The propulsion unit preferably comprises an outboard motor. When attached to the non-propulsion marine vehicle, the marine propulsion attachment ensures that the marine vehicle can sail on the sea from one place to another in a relatively short time. The handle disposed at the front end of the frame structure provides a person riding on the marine vehicle with increased stability and safety during sailing of the marine vehicle with propelling power from the propulsion unit.

The frame body may comprise a front part including the handle, a rear part including the transom board, and a central part disposed between the front part and the rear part, the central part and at least one of the front and rear parts of the frame body being removably connected to one another. Thus, the frame body can be separated into two or three parts. This structure is highly convenient for storage and transportation of the frame body.

Preferably, the central part is removably connected to the front part and the rear part, in which instance the frame body further comprises at least one additional central part having a different length than the central part, the central part and the at least one additional central part being replaceable with one another. By replacing the central part with the additional central part, it is possible to change the overall length of the frame body.

The connecting means preferably comprises a suction cup mounted to the frame body. The frame structure is placed on the non-self-propelled marine vehicle so that the suction cup contacts a top surface of the marine vehicle. By forcing the frame structure downward, a partial vacuum is created in the suction cup. The partial vacuum thus created tends to hold the suction cup in place. The suction cup is simple in construction and able to secure quick attachment and detachment of the frame structure relative to the marine vehicle.

The frame body preferably has a skeleton structure formed of plural pipe members connected together. The frame body of skeleton structure is relatively lightweight but has a high rigidity.

The frame body of skeleton structure may have a front part including the handle, a rear part including the transom board, and a central part disposed between the front part and the rear part, each of the front, rear and central parts having a pair of laterally spaced side members. The frame body further has a coupling device for removably connecting each of the side members of the central part and a respective one of the side members of at least one of the front part and the rear part of the frame body.

In one preferred from of the present invention, the coupling device comprises a hollow cylindrical plug member slidably fitted over and around opposite end portions of the side members of the central and front or rear parts of the frame body, and a hollow cylindrical socket member loosely fitted around one of the opposite end portions of the side members and threadedly engageable with the plug member to form the coupling device. The plug member is firmly secured to the other of the opposite end portions of the side members and has a split tapered end portion. The socket member has a tapered hole for slidably receiving therein the split tapered end portion of the plug member. When the socket member is turned in a screw tightening direction, an inner circumferential surface of the tapered hole of the socket member forces the split tapered end portion of the plug member to resiliently displace in a radial inward direction to thereby grip the one of the opposite end portions of the side members. The coupling device is relatively simple in construction and can readily make a joint between the central side member and the front or rear side member merely with a simple turning operation of the socket member relative to the plug member.

According to a third aspect of the present invention, there is provided a removable handle for a non-self-propelled marine vehicle, comprising a handle body of rod-like configuration having a grip portion at an end thereof for gripping by a person riding on the marine vehicle, and a suction cup mounted on an opposite end of the handle body for removably connecting the handle body to the marine vehicle.

The removable handle is particularly advantageous when used with a surfboard because a surfrider can enjoy a different riding feel or pleasure than as obtained when riding on a normal surfboard not equipped with a handle for support.

In one preferred form of the invention, the handle body has a generally inverted U shape and includes a horizontal head forming the grip portion and a pair of vertical stems extending downwardly from opposite ends of the horizontal head, the suction cup being mounted on a lower end of each of the vertical stems. As an alternative, the handle body may have a T-shaped configuration including a horizontal head having the grip portion at opposite ends thereof, and a vertical stem extending downward from a central portion of the horizontal head and provided with the suction cup at a lower end thereof.

BRIEF DESCRIPTION OF THE DRAWINGS

Certain preferred structural embodiments of the present invention will be described in detail herein below, by way of example only, with the reference to the accompanying drawings, in which.

DETAILED DESCRIPTION OF THE PREFERRED EMBODIMENTS

Figure 1:
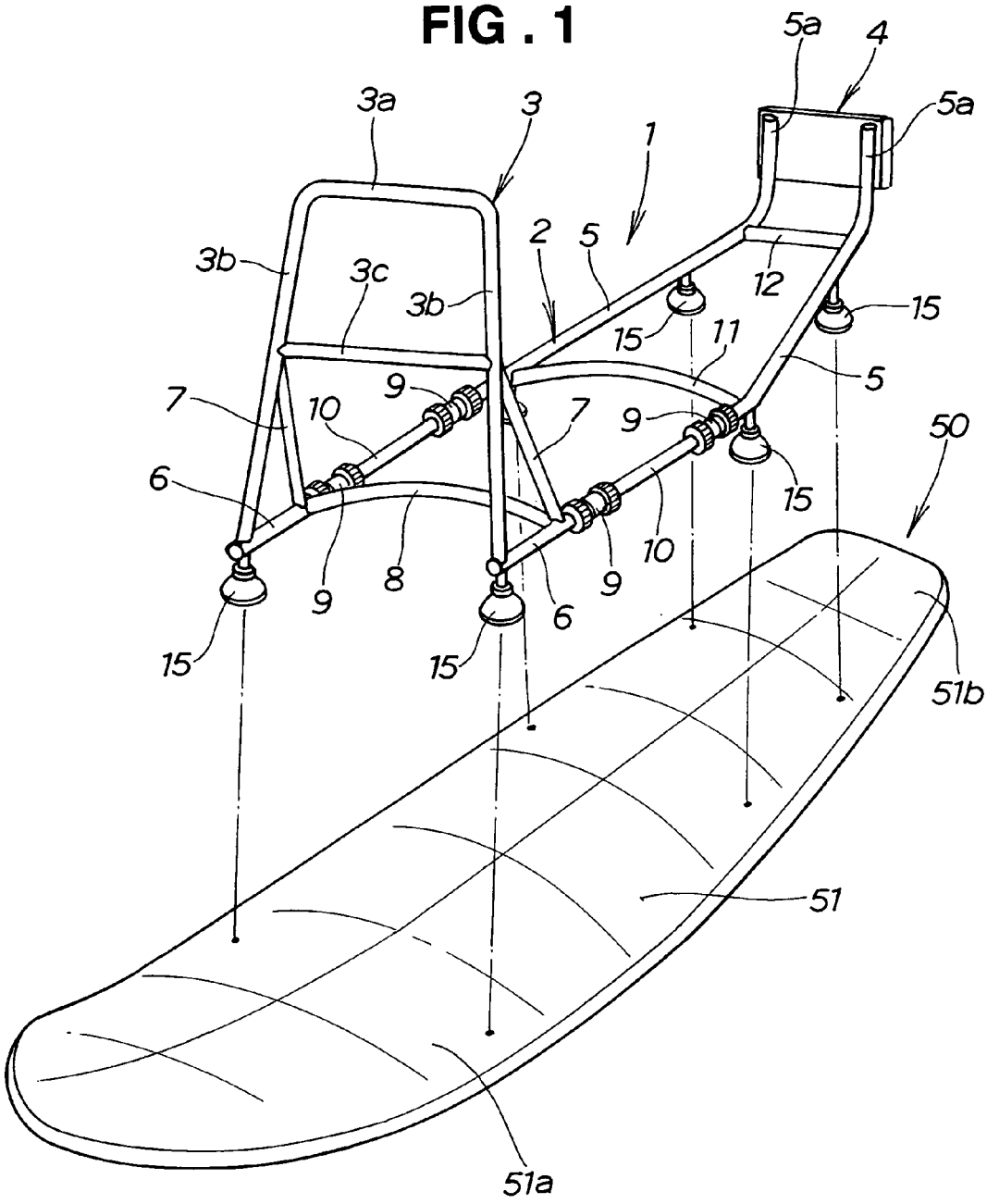
FIG. 1 is a perspective view of a frame structure for attachment of a propulsion unit to a surfboard according to a first embodiment of the present invention.

Referring now to the drawings and FIG. 1 in particular, there is shown in perspective a frame structure 1 according to a first embodiment of the present invention. The frame structure 1 is used for attachment of a propulsion unit or device 20 (FIG. 9) to a non-self-propelled marine vehicle. In the first embodiment shown in FIG. 1 the non-self-propelled marine vehicle takes the form of a surfboard 50. As shown in FIG. 10, the frame structure 1 and the propulsion unit 20 attached to the frame structure 1 jointly form a marine propulsion attachment 60 for the surfboard (non-self-propulsion marine vehicle) 50.

Referring back to FIG. 1, the surfboard 50 has a long, narrow body 51 tapered at opposite ends to form a nose and a tail. A front portion 51*a* of the surfboard body 51 is larger in width than a rear portion 51*b*, and the bottom of the surfboard body 51 is properly shaped to undergo surfing.

The frame structure 1 generally comprises a frame body 2 of generally elongated ladder-like configuration, a handle 3 disposed at a front end (left end in FIG. 1) of the frame body 2 for holding by a person R (FIG. 10) riding on the surfboard 50 (hereinafter referred to for brevity as "surfrider"), a substantially vertical transom board 4 disposed at a rear end (right end in FIG. 1) of the frame body 2 for attachment of the propulsion unit 20 (FIG. 9) to the frame structure 1, and a connecting means or connectors 15 provided on the frame body 2 for removably connecting the frame structure 1 to the surfboard 50. The connecting means 15 comprises a plurality of suction cups (also called "vacuum cups") mounted to the frame body 1.

Figure 5:
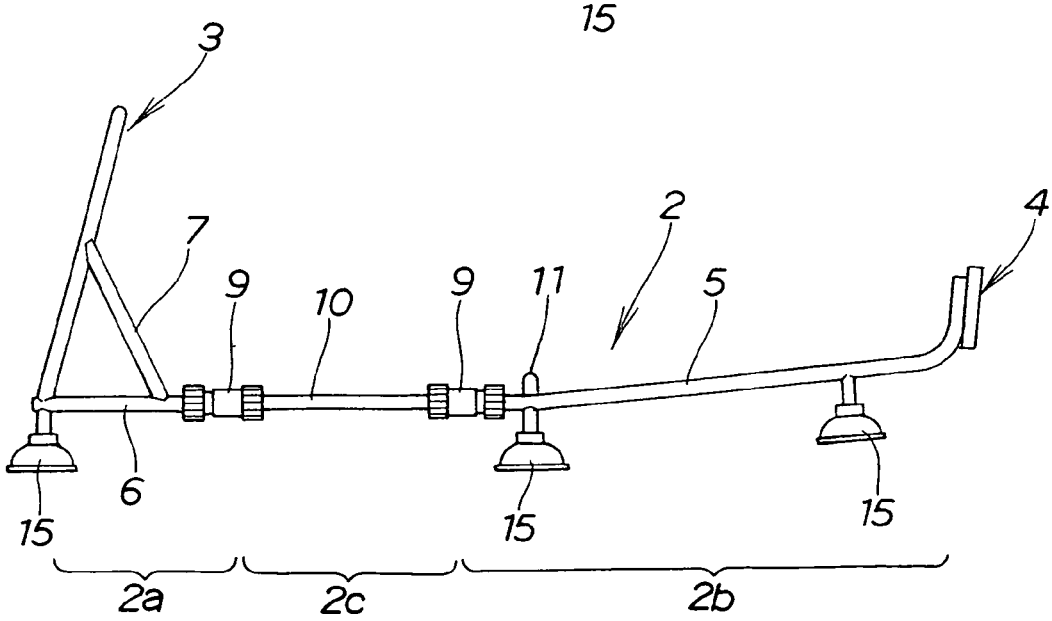
FIG. 5 is a left side view of the frame structure.
Figure 6:
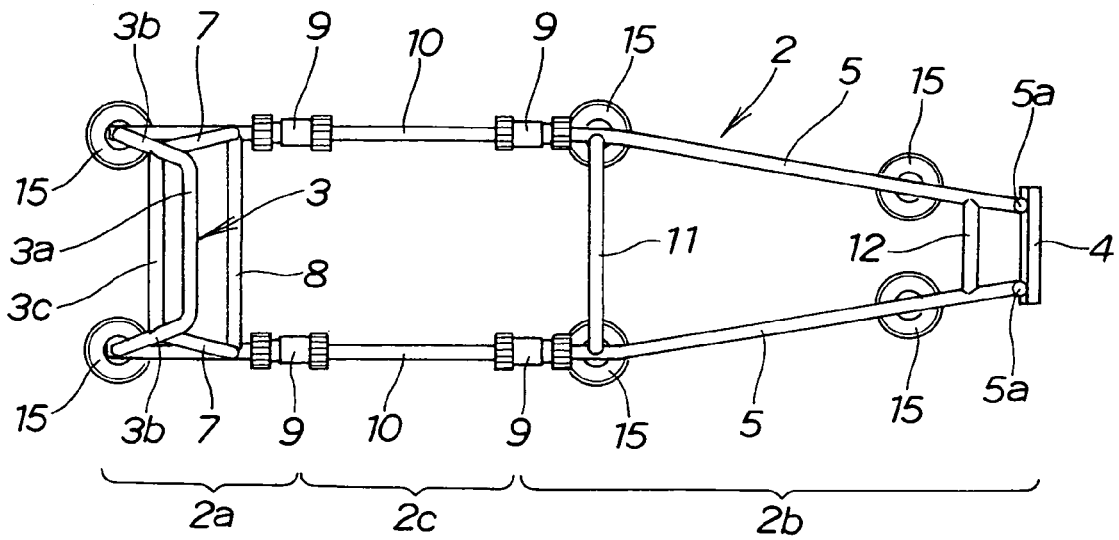
FIG. 6 is a plan view of FIG. 5

The frame body 2 has a skeleton structure formed of plural pipe members connected together. As shown in FIGS. 5 and 6, the generally elongated ladder-like frame body 2 of skeleton structure has a front part 2*a* including the handle 3, a rear part 2*b* including the transom board 4, and a central part 2*c* disposed between the front and rear parts 2*a* and 2*b*. The front part 2*a* and the central part 2*c* are removably connected together by two coupling devices 9, 9, and the central part 2*c* and the rear part 2*b* are removably connected together by two coupling devices 9, 9. With this construction, the frame body 2 can be disassembled into three separate parts (i.e., the front, rear and central parts 2*a*, 2*b* and 2*c*) and hence is particularly advantageous in terms of storage and transportation of the frame structure 1.

Figure 2:
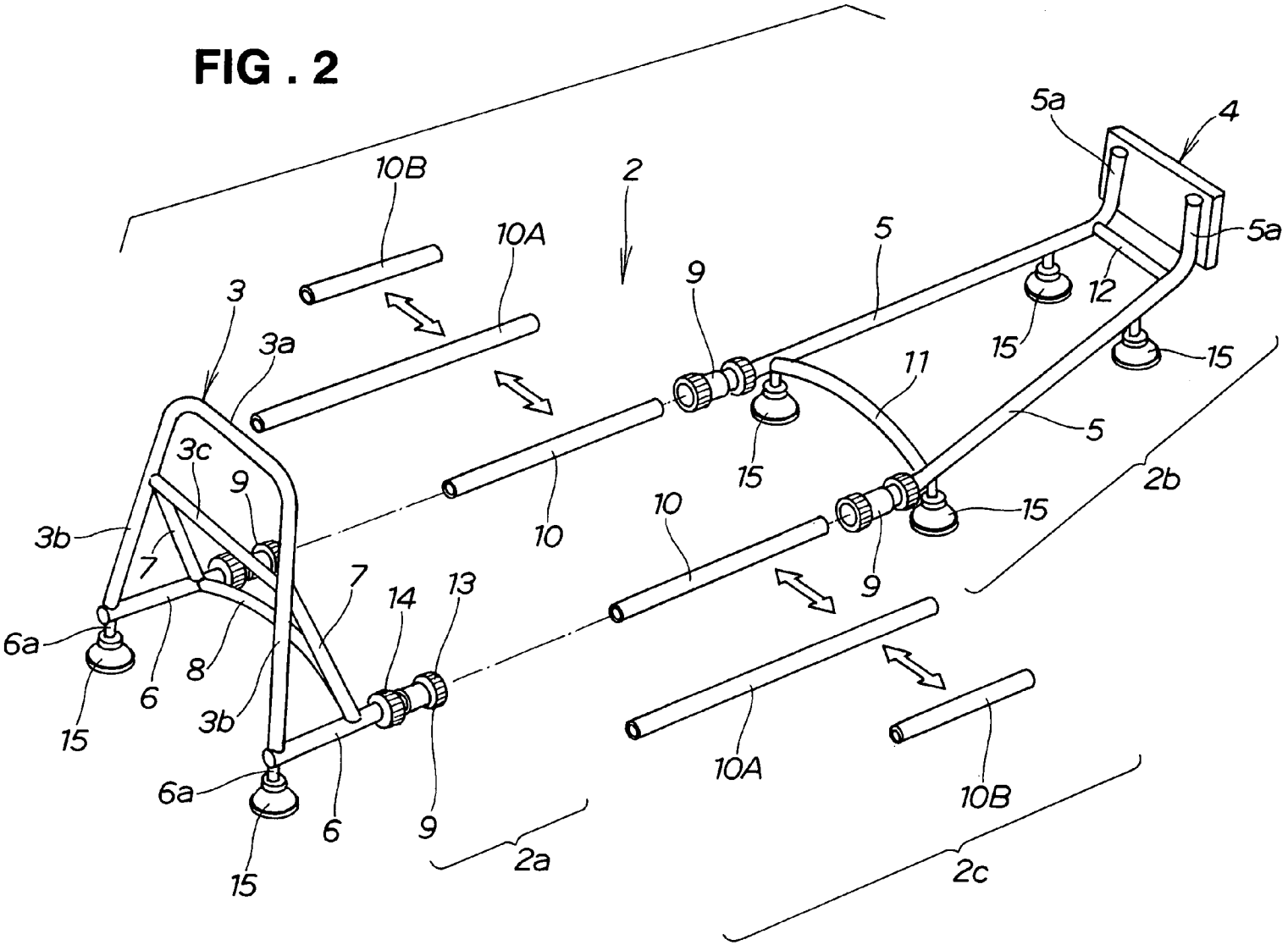
FIG. 2 is an exploded perspective view of the frame structure shown with additional side members provided for replacement with current side members to change the overall length of the frame structure.

As shown in FIG. 2, the front part 2*a* of the frame body 2 has a pair of front side members 6, 6 parallel spaced in a transverse or widthwise direction of the frame body 2, and a cross member 8 extending between respective rear end portions of the front side members 6, 6. The cross member 8 has a slightly upwardly bent or arcuate configuration. The handle 3 has an inverted U-shape configuration including a horizontal head 3*a* extending widthwise of the frame body 2 and a pair of vertical stems 3*b*, 3*b* extending downward from opposite ends of the horizontal head 3*a* and connected to respective front end portions of the front side members 6, 6. The horizontal head 3*a* of the handle 3 forms a grip portion of the handle 3 for gripping by the surfrider R (FIG. 10). The horizontal head 3*a* and the vertical stems 3*b*, 3*b* constitute a handle body that has a length sufficient to enable the surfrinder R to stand upright on the surfboard 50 while gripping the grip portion 3*a*. The handle 3 includes a cross member 3*c* disposed below the horizontal head or grip portion 3*a* and extending widthwise of the frame body 2 between respective intermediate portions of the vertical stems 3*b*, 3*b* that are located closer to the grip portion 3*a* than to the lower ends of the vertical stems 3*b*, 3*b*. The handle 3 is slightly inclined backward and is supported by a pair of reinforcement members 7, 7 extending between the rear end portions of the front side members 6, 6 and the intermediate portions of the vertical stems 3*b*, 3*b*.

The front part 2*a* of the frame body 2 is provided with two suction cups 15, 15 disposed on undersides of the respective front end portions of the front side members 6, 6 in such an orientation that concave surfaces of the suction cups 15 face downward. In FIG. 2, two coupling devices 9, 9 used for removable connection between the front part 2*a* and the central part 2*c* of the frame body 2 are shown as being mounted on the respective rear ends of the front side members 6, 6 for purposes of illustration.

The rear part 2*b* of the frame body 2 has an elongated trapezoidal shape tapering or reducing in width toward the rear end of the frame body 2. The rear part 2*b* includes a pair of rear side members 5, 5, a front cross member 11 extending between respective front end portions of the rear side members 5, 5, and a rear cross member 12 extending between respective rear end portions of the rear side members 5, 5. The front cross member 11 has a slightly upwardly bent or arcuate configuration, while the rear cross member 12 has a rectilinear configuration. The rear side members 5, 5 each have a rear end portion 5*a* bent upward, and the transom board 4 is connected by welding, for example, to the upwardly bent rear end portions 5*a*, 5*a* of the rear side members 5, 5.

The rear part 2*b* of the frame body 2 is provided with four connectors in the from of suction cups 15 disposed on undersides of the rear side members 5, 5 in such a manner that two suction cups 15 are located at junctions between the front cross member 11 and the rear side members 5, 5, and the remaining two suction cups 15 are located near the rear cross member 12. For purposes of illustration, two coupling devices 9, 9 used for removable connection between the rear part 2*b* and the central part 2*c* of the frame body 2 are shown as being mounted on the respective front ends of the rear side members 5, 5.

The central part 2*c* of the frame body 2 includes a pair of parallel spaced central side members 10, 10. The central side members 10, 10 each have a front end and a rear end that are removably connected by two of the four coupling devices 9 to the rear end of a corresponding one of the front side members 6, 6 and the front end of a corresponding one of the rear side members 5, 5, respectively. The central part 2*c* is further provided with two pairs of additional central side members 10A and 10B of different lengths. The central side members 10 are shorter than the first additional central side members 10A but longer than the second additional central side members 10B. These three pairs of central side members 10, 10A and 10B of different lengths are replaceable with one another, so that the length of the frame body 2 (substantially equal to the length of the frame structure 1) can be changed according to the length of a surfboard 50 (FIG. 1) used or the preference of the surfrider. At least the front, rear and central side members 6, 5 and 10 have the same outside diameter.

Figure 3:
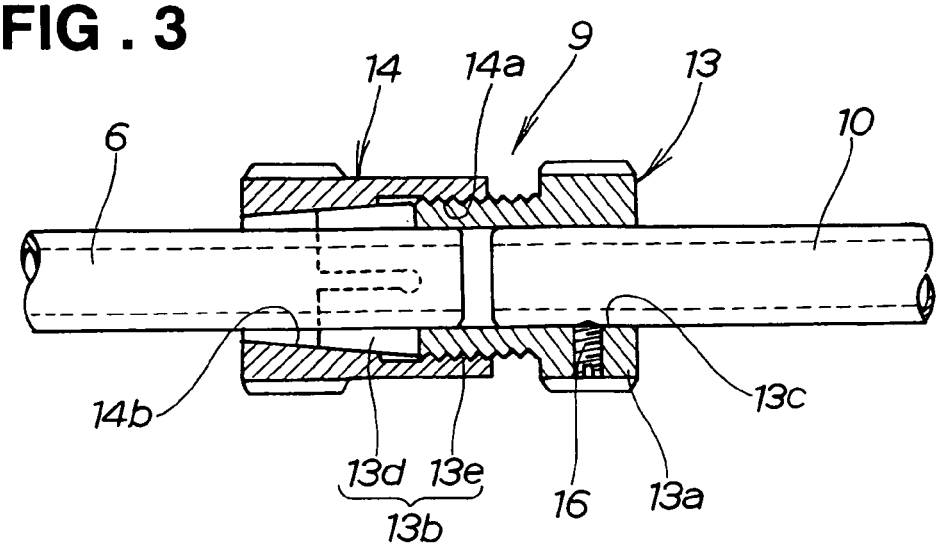
FIG. 3 is an enlarged cross-sectional view of a coupling device used for removable connection between a front part and a central part of the frame structure.

All of the coupling devices 9 are identical in structure and function. FIG. 3 shows in cross section one of the coupling devices 9, which is used for removably connecting each central cross member 10 and a corresponding front side member 6. The coupling device 9 is formed by an inner plug member 13 and an outer socket member 14 threadedly engageable with each other. The plug member 13 has a hollow cylindrical shape having an enlarged head 13*a* and a stem 13*b* extending from the enlarged head 13*a*. The plug member 13 also has an axial central hole 13*c* extending throughout the length of the plug member 13. The hole 13*c* has a diameter slightly larger than the outside diameter of the front and central side members 6, 10. The stem 13*b* has a split tapered tip end portion 13*d* and an externally threaded body portion 13*e* extending between the enlarged head 13*a* and the split tapered tip end portion 13*d*. The plug member 13 is firmly secured to the central side member 10 by a set screw 16 extending radially through the head portion 13*a*. The socket member 14 has an internally threaded hole 14*a* extending from one end to an intermediate portion of the socket member 14 for threaded engagement with the threaded body portion 13*e* of the plug member 13, and a tapered hole 14*b* extending contiguously from an inner end of the threaded hole 14*a* to the other end of the socket member 14 for sliding engagement with the split tapered tip end portion 13*d* of the plug member 13.

In order to connect the front side member 6 and the central side member 10, the plug member 13 is firmly secured by the set screw 16 to the front end portion of the central side member 10. Then, with the socket member 14 loosely fitted around the rear end portion of the front side member 6, the rear end portion of the front side member 6 is inserted into the axial hole 13*c* of the plug member 13 until it becomes end to end confrontation with the front end portion of the central side member 10. Thereafter, the socket member 14 is placed over the split tapered tip end portion 13*d* of the stem 13*b* of the plug member 13 and by rotating the socket member 14 in a screw tightening direction, the threaded hole 13*e* of the socket member 14 comes in threaded engagement with the threaded body portion 13*e* of the stem 13*b* of the plug member 13. Continued rotation of the socket member 14 causes the socket member 14 to advance toward the head 13*a* of the plug member 13. During that time, a circumferential surface of the tapered hole 14*d* of the socket member 14 forces the split tapered tip end portion 13*d* of the plug member 13 to resiliently displace in a radial inward direction to thereby grip the rear end portion of the front side member 6. The front and central side members 6, 10 are thus connected together end to end by the coupling device 9.

When the front and central side members 6, 10 are to be separated from one another, the socket member 14 is rotated in a screw loosening direction. This will allow the split tapered tip end portion 13*d* of the plug member 13 to spring back in a radial outward direction to restore its original shape. The front side member 6 now can be removed from the axial hole 13*a* of the plug member 13.

Figure 4:
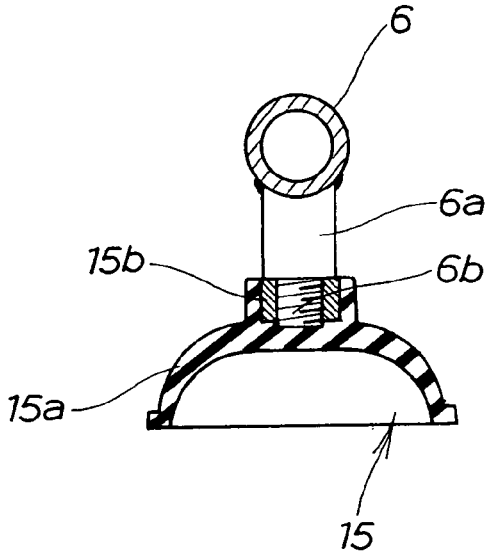
FIG. 4 is an enlarged cross-sectional view of a suction sup of the frame structure.
Figure 7:
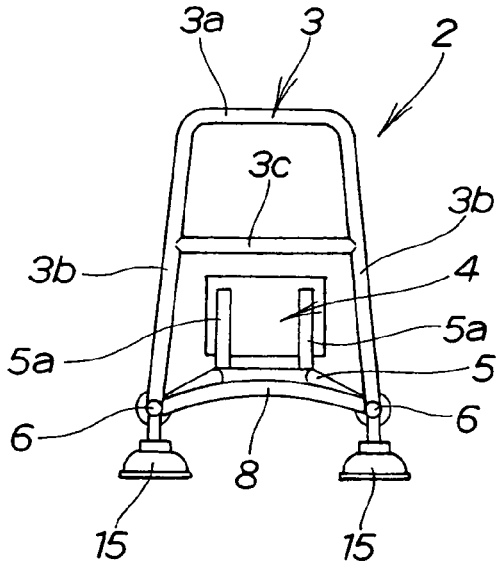
FIG. 7 is a front view of FIG. 5.

All of the connectors or suction cups 15 are identical in structure and function. FIG. 4 shows in cross section one of the suction cups 15, which is located at the front end of each front side member 6. The front side member 6 includes a support leg 6*a* extending vertically downward from the front end thereof and having an externally threaded tip end portion 6*b*. The suction cup 15 has a cup-shaped body formed from an elastic material such as rubber, and a nut 15*b* embedded in a closed end portion (bottom portion) of the cup-shaped body 15*a*. The nut 15*b* is threadedly engaged with the externally threaded tip end portion 6*b* of the support leg 6*a*, so that the suction cup 15 is mounted on the front end of the front side member 6 of the frame body 2. Respective locations of the suction cups 15 relative to the frame body 2 are clearly shown in FIGS. 5 to 7.

The frame structure 1 of the foregoing construction is placed on the surfboard 50 so that the suction cups 15 contact a top surface of the surfboard body 51. By forcing the frame structure 1 downward, a partial vacuum is created in each of the suction cups 15, tending to hold the suction cup 15 in place. The frame structure 1 is thus attached to the surfboard 50, as shown in FIG. 8.

Figure 8:
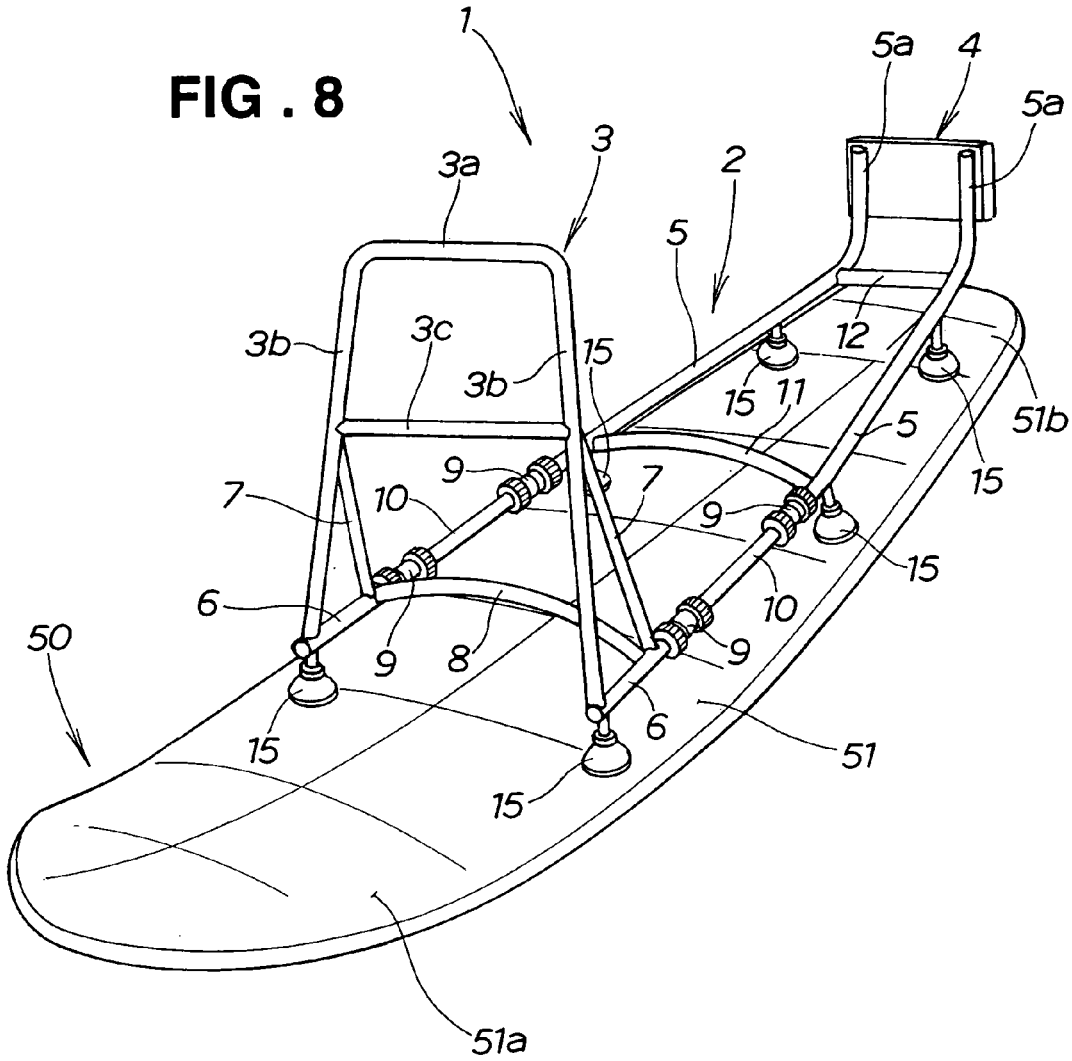
FIG. 8 is a view similar to FIG. 1, but showing the frame structure as attached to the surfboard.
Figure 9:
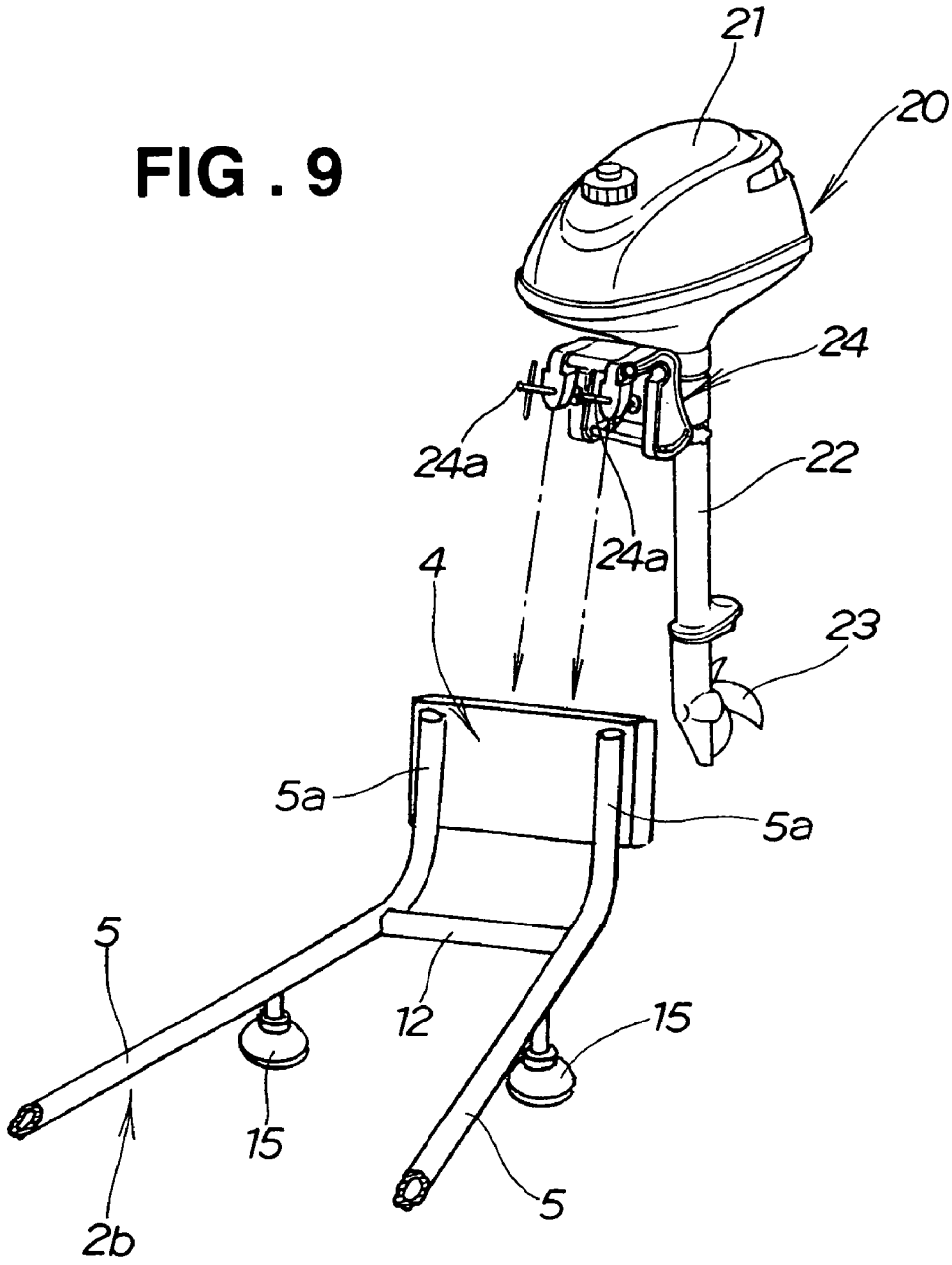
FIG. 9 is a perspective view illustrative of the manner in which an outboard motor as a propulsion unit is attached to a transom board of the frame structure to complete a removable marine propulsion attachment.
Figure 10:
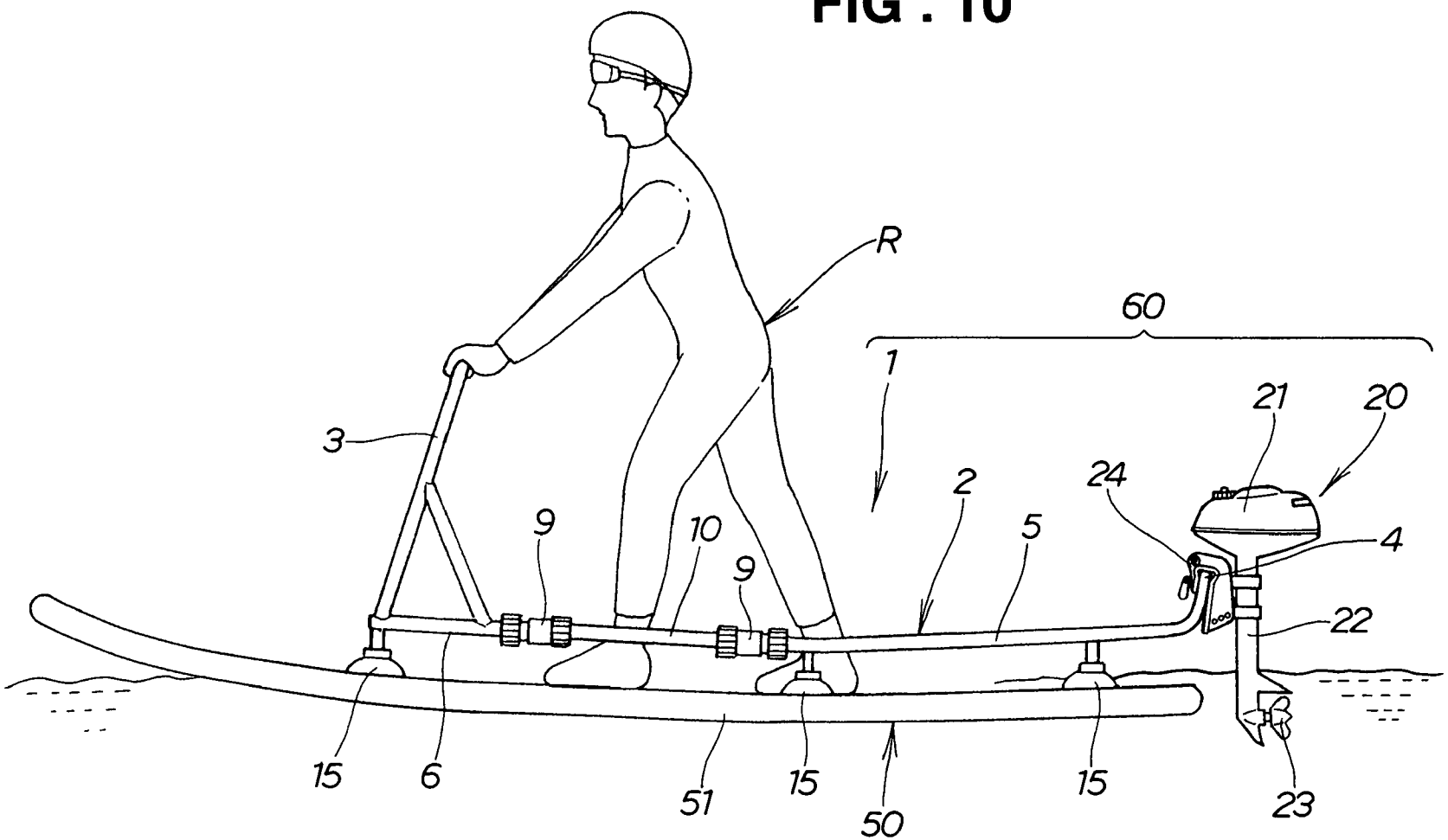
FIG. 10 is a side view illustrative of the manner in which a surfboard is propelled by the marine propulsion attachment of the invention.

FIG. 9 shows a propulsion unit 20 as it is about to be mounted on the transom board 4 at the rear end of the frame structure 1 (FIG. 8). The propulsion unit comprises an outboard motor 20 having an engine cover 21, an extension case 22 extending downward from a lower end of the engine cover 21, a screw propeller 23 at a lower end of the outboard motor 20, and a stern bracket 24 provided for attachment of the outboard motor 20 to the transom board 4. The stern bracket 24 has a hook-like configuration. For attachment, the stern bracket 24 is hooked on the transom board 4 and firmly secured to the transom board 4 by clamp screws 24*a*, 24*a*. The outboard motor 20 is thus attached to the transom board 4 of the frame structure 1, as shown in FIG. 10.

As is well known, the outboard motor 20 includes an engine disposed inside the engine cover 21, a drive shaft extending inside the extension case 22, and a gear box disposed in front of the screw propeller 23. The outboard motor 20 is mounted to undergo swivel movement about a vertical axis for steering the surfboard 50 and also undergo pivotal movement about a horizontal axis between a vertical operating position (FIG. 10) and a tilt-up standby position.

As shown in FIG. 10, the marine propulsion attachment 60 attached to the surfboard 50 changes the surfboard 50 to a self-propelled marine vehicle. The surfrider R rides on the surfboard 50 while gripping the grip portion 3*a* (FIG. 8) of the handle 3. Though not shown, the handle 3 is equipped with a throttle lever extending along the grip portion for manipulation with a hand of the surfrider R so as to regulate the engine speed via a throttle cable extending between the throttle lever and the engine. During sailing on the sea of the surfboard 50 with propelling power of the outboard motor 20, the surfrider R may move or shift its gravitational center to the left or right for steering the surfboard 50 or enjoying surfriding. By thus using propelling power of the outboard motor 20, the surfrider R can readily move from one surfriding point to another in a relatively short time. Upon arrival at a desired surfriding point, the surfrider R may remove the propulsion attachment 60 from the surfboard 50 if he or she prefers normal surfriding. In this instance, removal of the propulsion attachment 60 can be readily achieved by separating the suction cups from the surfboard 50.

As an alternative, the frame structure 1 may be removed in such a manner that the front frame body part 2*a* including the handle 3 still remains attached on the surfboard 50 by means of the suction cups 15. This arrangement permits the surfrider R to play surfing while griping the grip portion 3*a* of the handle 3. The handle 3 may be a T-shaped handlebar having a horizontal head formed with grip portions at opposite ends thereof, and a vertical stem provided with a suction cup at a lower end thereof for removable connection of the T-shaped handle relative to the surfboard 50.

Figure 11:
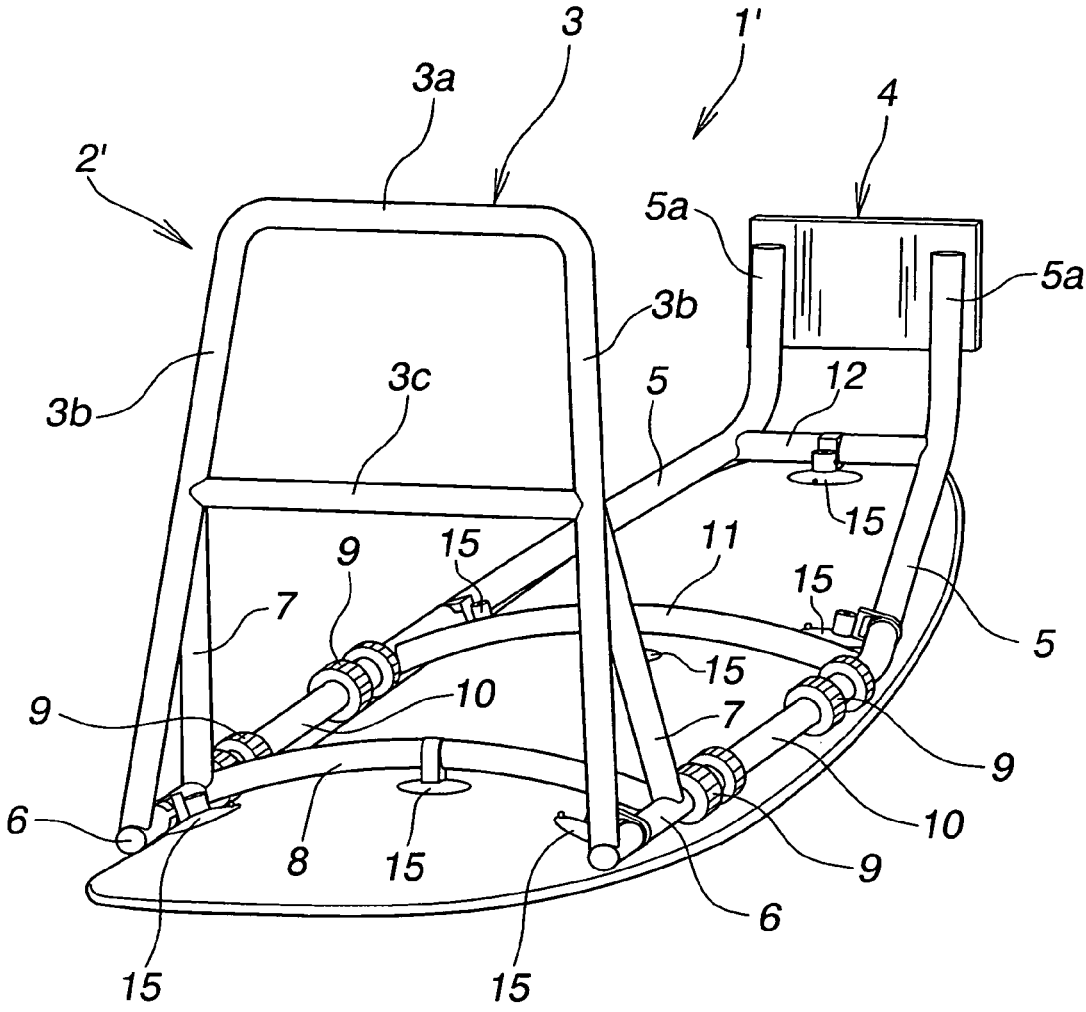
FIG. 11 is a perspective view of a modified frame structure as it is attached to a surfboard.

FIG. 11 shows a modified form of the removable frame structure according to the invention. The modified frame structure 1' differs in the number and location of the suction cups 15 from the frame structure 1 shown in FIG. 8. Stated more specifically, three out of seven suction cups 15 are mounted on respective central portions of the cross members 8, 11 and 12. Two out of the remaining four suction cups are each located at the junction between the front cross member 8 and a respective one of the front side members 6. The remaining two suction cups 15 are each mounted on a respective one of the rear side members 5 at a position located near the junction between the rear side member 5 and the cross member 11. The suction cups 15 thus arranged ensures that the frame structure 1' can be attached to the surfboard 50 with increased stability and firmness. The number and location of the suction cups can be changed according to the size of a surfboard to which the frame structure 1, 1' is to be attached.

FIGS. 12 to 15 show a marine propulsion attachment 160 (FIGS. 12 and 14) according to a second embodiment of the present invention, including a frame structure 101 configured to attach two propulsion units 120 to a canoe 150. The canoe 150 is larger in width than the surfboard discussed previously and has a relatively shallow and flat bottom. The propulsion units comprise two outboard motors 120, 120.

Figure 12:
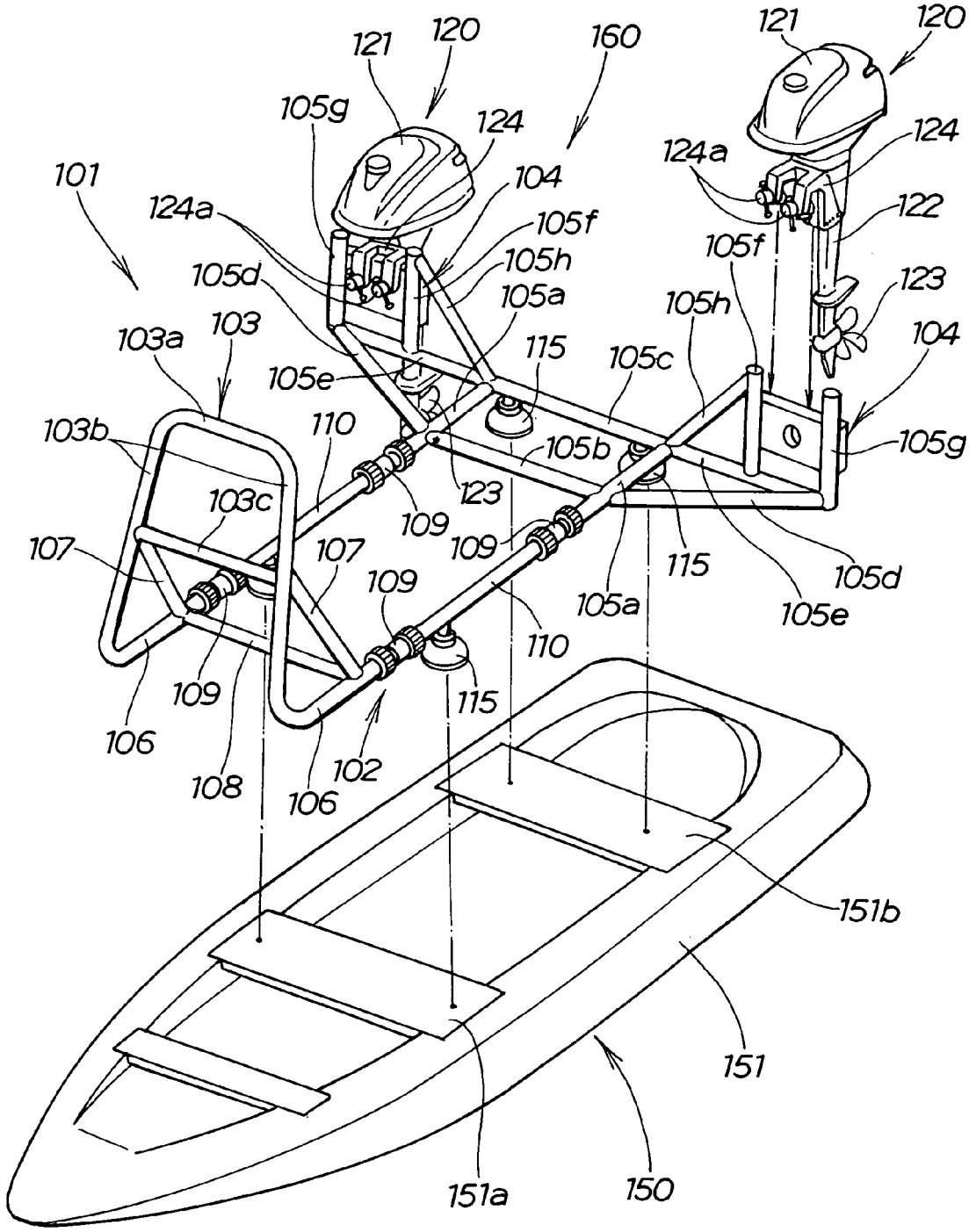
FIG. 12 is a perspective view of a marine propulsion attachment according to a second embodiment of the present invention, including a frame structure configured to attach two propulsion units to a canoe.

The frame structure 101 generally comprises a frame body 102 of generally elongated ladder-like configuration with a pair of lateral wings at a rear end (right end in FIG. 12) thereof, a handle 103 disposed at a front end deft end in FIG. 12) of the frame body 2 for holding by a person (not shown) riding on the canoe 150, a pair of substantially vertical transom boards 4 disposed on the lateral wings, respectively, at a rear end of the frame body 2 for attachment of the outboard motors 120, 120 to the frame structure 101, and a plurality of suction cups 115 provided as a connecting means on the frame body 102 for enabling removable connection between the frame structure 101 and the canoe 150.

Figure 13:
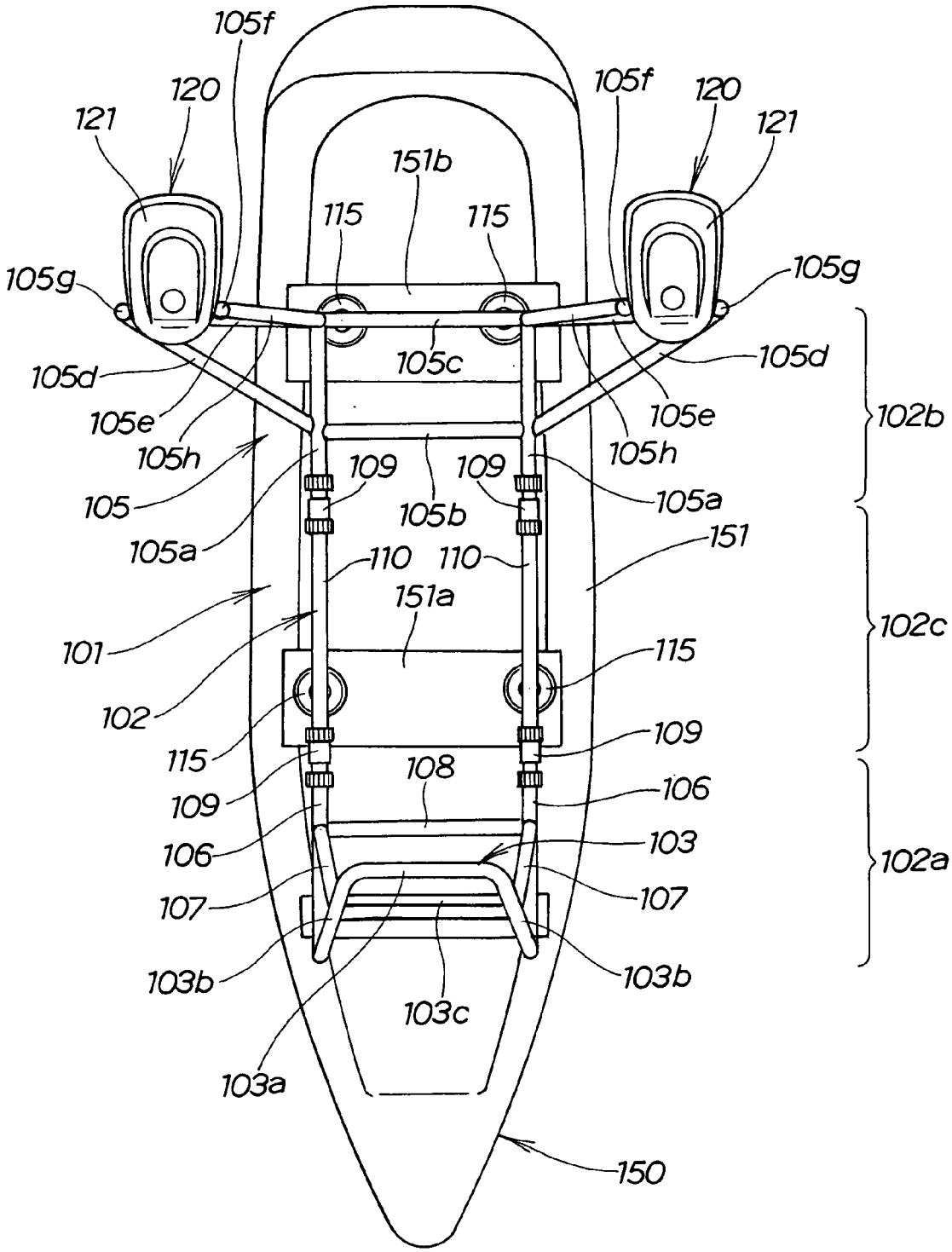
FIG. 13 is a plan view the marine propulsion attachment of FIG. 12.
Figure 14:
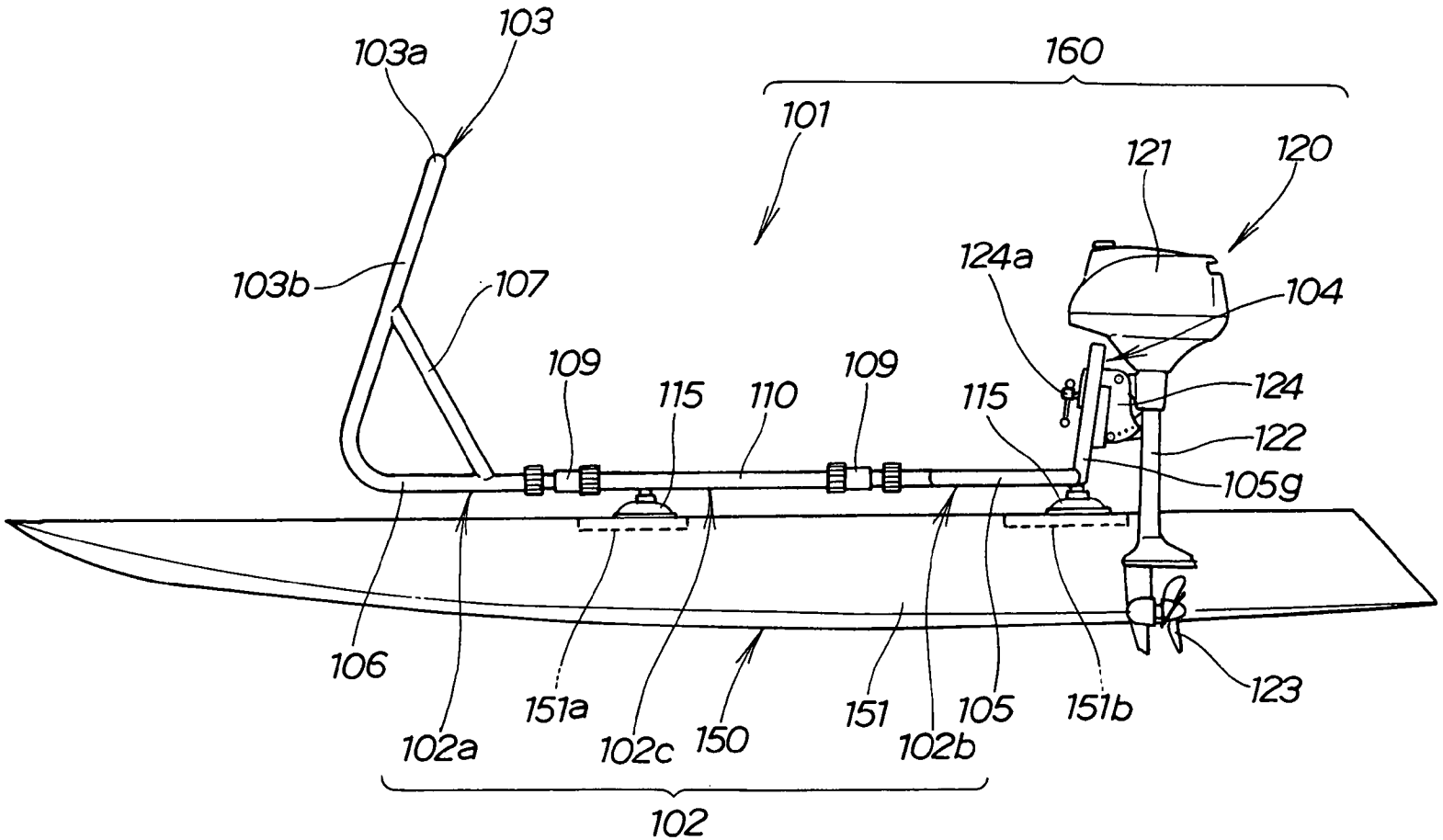
FIG. 14 is a left side view of FIG. 13.

The frame body 102 has a skeleton structure formed of plural pipe members connected together. As shown in FIGS. 13 and 14, the frame body 2 of skeleton structure has a front part 102*a* including the handle 103, a rear part 102*b* including the transom boards 4, and a central part 102*c* disposed between the front and rear parts 102*a* and 102*b*. The front part 102*a* and the central part 102*c* are removably connected together by two coupling devices 109, 109, and the central part 102*c* and the rear part 102*b* are removably connected together by two coupling devices 109, 109. With this construction, the frame body 102 can be disassembled into three separate parts (i.e., the front, rear and central parts 102*a*, 102*b* and 102*c*).

The front part 102*a* of the frame body 102, as shown in FIG. 12, has a pair of parallel laterally spaced front side members 106, 106, and a cross member 108 extending between respective rear end portions of the front side members 106, 106. The cross member 108 has a rectilinear configuration. The handle 103 has an inverted V-shape configuration including a horizontal head 103*a* and a pair of vertical stems 103*b*, 103*b* extending downward from opposite ends of the horizontal head 103*a* and blending into respective front end portions of the front side members 106, 106. The horizontal head 103*a* of the handle 103 forms a grip portion of the handle 103 for gripping by the person riding on the canoe 150. The handle 103 includes a cross member 103*c* disposed below the horizontal head or grip portion 103*a* and extending between respective intermediate portions of the vertical stems 103*b*, 103*b*. The handle 103 is slightly inclined backward and is supported by a pair of reinforcement members 107, 107 extending between the rear end portions of the front side members 106, 106 and the intermediate portions of the vertical stems 103*b*, 103*b*.

The rear part 102*b* (FIG. 13) of the frame body 102 includes a pair of parallel spaced rear side members 105, 105, a front cross member 105*b* extending between respective front end portions of the rear side members 105, 105, and a rear cross member 105*c* extending between respective rear end portions of the rear side members 105, 105. The rear part 102*b* also includes a pair of first reinforcement members 105*e* projecting laterally outward from the respective front end portions of the rear side members 105*a* in a backward direction of the frame body 102 and connected to free ends of lateral extensions 105*e* of the rear cross member 105*c*, a pair of parallel spaced support members 105*f* and 105*g* projecting vertically upward from each of the lateral extensions 105*e* for supporting one of the transom boards 104, 104, and a pair of second reinforcement members 105*h* extending diagonally between proximal ends of the lateral extensions 105*e* and upper ends of inner support members 105*f*. The members 105*d*–105*h* jointly form the lateral wings of the frame body 102. By virtue of the first and second reinforcement members 105*d* and 105*h*, each of the lateral wings has two trusses formed therein, one in a horizontal plane and the other in a vertical plane. The lateral wing having such truss structure is rigid enough to support the outboard motor 120. The rear part 102 has two suction cups 115 mounted on the rear cross member 105.

The central part 102*c* comprises a pair of parallel spaced central side members 110, 110. Each of the central side members 110 has a front end removably connected by one coupling device 109 to the rear end of a corresponding one of the front side members 106. A rear end of each central side member 110 is also removably connected by another coupling device 109 to the front end of a corresponding one of the rear side members 105*a*. The central part 102 has two suction cups 115 mounted on undersides of respective front end portions of the central side members 110, 110. The coupling devices 109 are structurally and functionally the same as the coupling devices 9 described previously with reference to FIG. 3. Similarly, the suction cups 115 are the same in structure and function as the suction cups 15 described previously with reference to FIG. 4. Though not shown, the central part 102 is provided with at least one pair of additional central side members having a length different from the length of the central side members 110, so that the overall length of the central part 102 can be changed by replacing the central side member 110 with the additional central side members.

Figure 15:
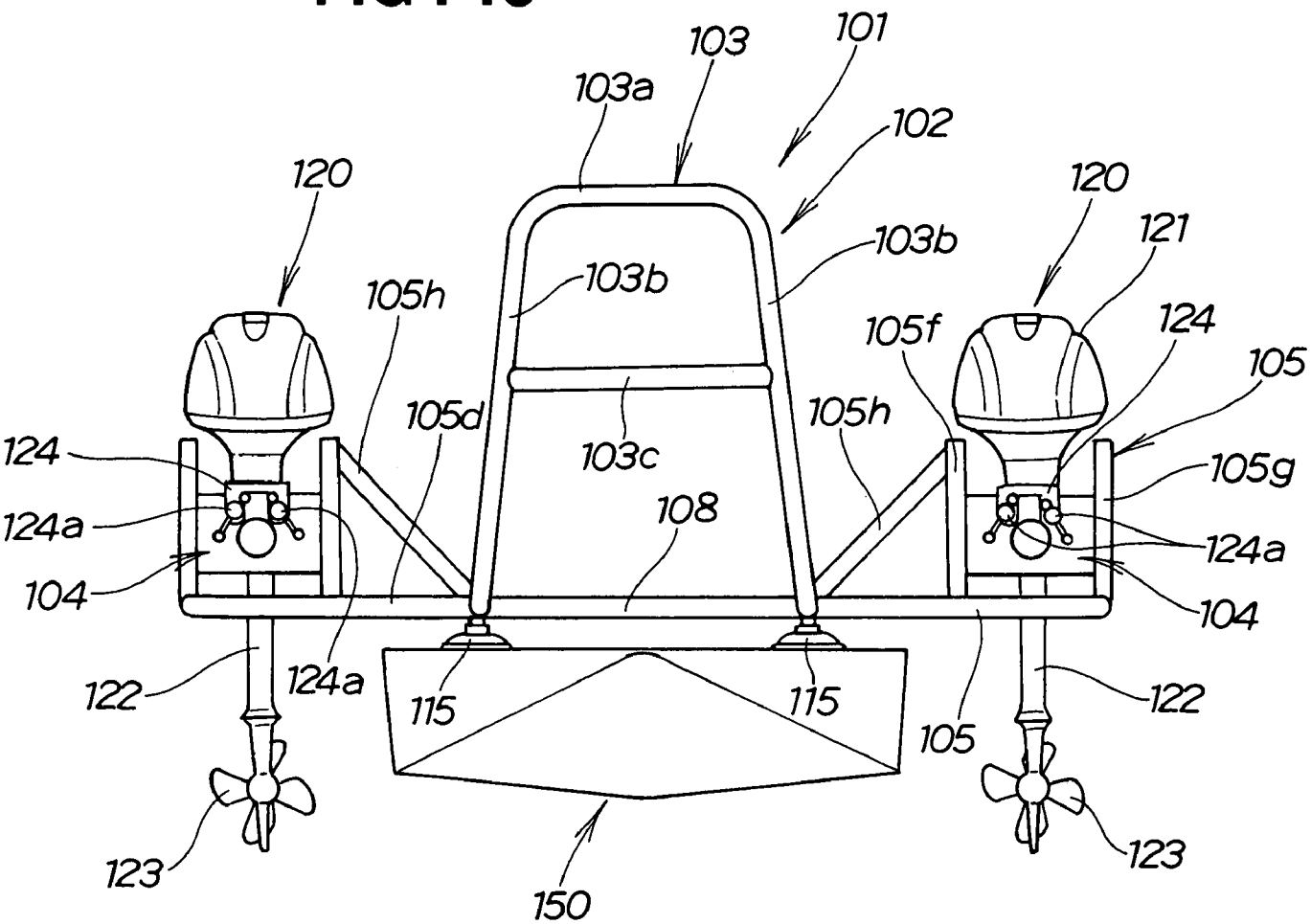
FIG. 15 is a front view of FIG. 13.

For operation, the frame structure 101 of the foregoing construction is placed on the canoe 150 so that the suction cups 15 contact top surfaces of front and rear support members 151*a* and 151*b* extending transversely between left and right sides (stroke-side and bow-side) of a body 151 of the canoe 150. In this instance, the outboard motors 120 are removed from the frame structure 101. Then by forcing the frame structure 101 downward, a partial vacuum is created in each of the suction cups 115, tending to hold the suction cup 115 in place. The frame structure 101 is thus attached to the canoe 150, as shown in FIGS. 13–15. In this condition, the lateral wings including the transom boards 104 of the frame structure 101 project laterally outward from the left and right sides of the canoe 150.

Thereafter, the outboard motors 120 are mounted on the transom boards 104 of the frame structure 101 to thereby complete the marine propulsion attachment 160. The outboard motors 120 are identical in construction and performance with each other. The outboard motors 120 each include an engine cover 121, an extension case 122 extending downward from a lower end of the engine cover 121, a screw propeller 123 at a lower end of the outboard motor 120, and a stern bracket 124 provided for attachment of the outboard motor 120 to the transom board 104. The stern bracket 124 has a hook-like configuration. For attachment, the stern bracket 124 is hooked on the transom board 104 and firmly secured to the transom board 104 by clamp screws 124*a*, 124*a*. As is well known, the outboard motor 120 includes an engine disposed inside the engine cover 121, a drive shaft extending inside the extension case 122, and a gear box disposed in front of the screw propeller 123. The outboard motor 120 is mounted to undergo swivel movement about a vertical axis for steering the canoe 150 and also undergo pivotal movement about a horizontal axis between a vertical operating position (FIGS. 12–15) and a tilt-up standby position.

With the marine propulsion attachment 160 mounted thereon, the canoe 150 as a non-self-propelled marine vehicle is changed to a self-propelled marine vehicle. The marine propulsion attachment 160 having twin outboard motors 120, 120 is able to generate a greater propelling force than the marine propulsion attachment 60 with a single outboard motor 12 shown in FIG. 10. Though not shown, the handle 103 is provided with a pair of throttle levers extending along the grip portion for gripping separately with left and left hands the person riding on the canoe 150, so as to regulate engine speeds of the outboard motors 120, 120 via throttle cables extending between the throttle levers and the associated engines. When the canoe 150 is to be steered in one direction, one throttle lever disposed on a side opposite to the steering direction is gripped deeper than the other throttle lever.

FIGS. 16–20 show a marine propulsion attachment according to a third embodiment of the present invention, including a frame structure 201 designed for attachment to two surfboards 250, 250.

The frame structure 201 generally comprises a frame body 202 of generally elongated ladder-like configuration, a handle 203 disposed at a front end (left end in FIG. 16) of the frame body 202 for holding by a person (not shown) riding on the surfboards 250, a substantially vertical transom board 204 disposed at a rear end portion (right end in FIG. 16) of the frame body 202 for attachment of a propulsion unit 220 to the frame structure 201, and suction cups 215 provided on the frame body 202 for removably connecting the frame structure 201 to the surfboards 250.

Figure 16:
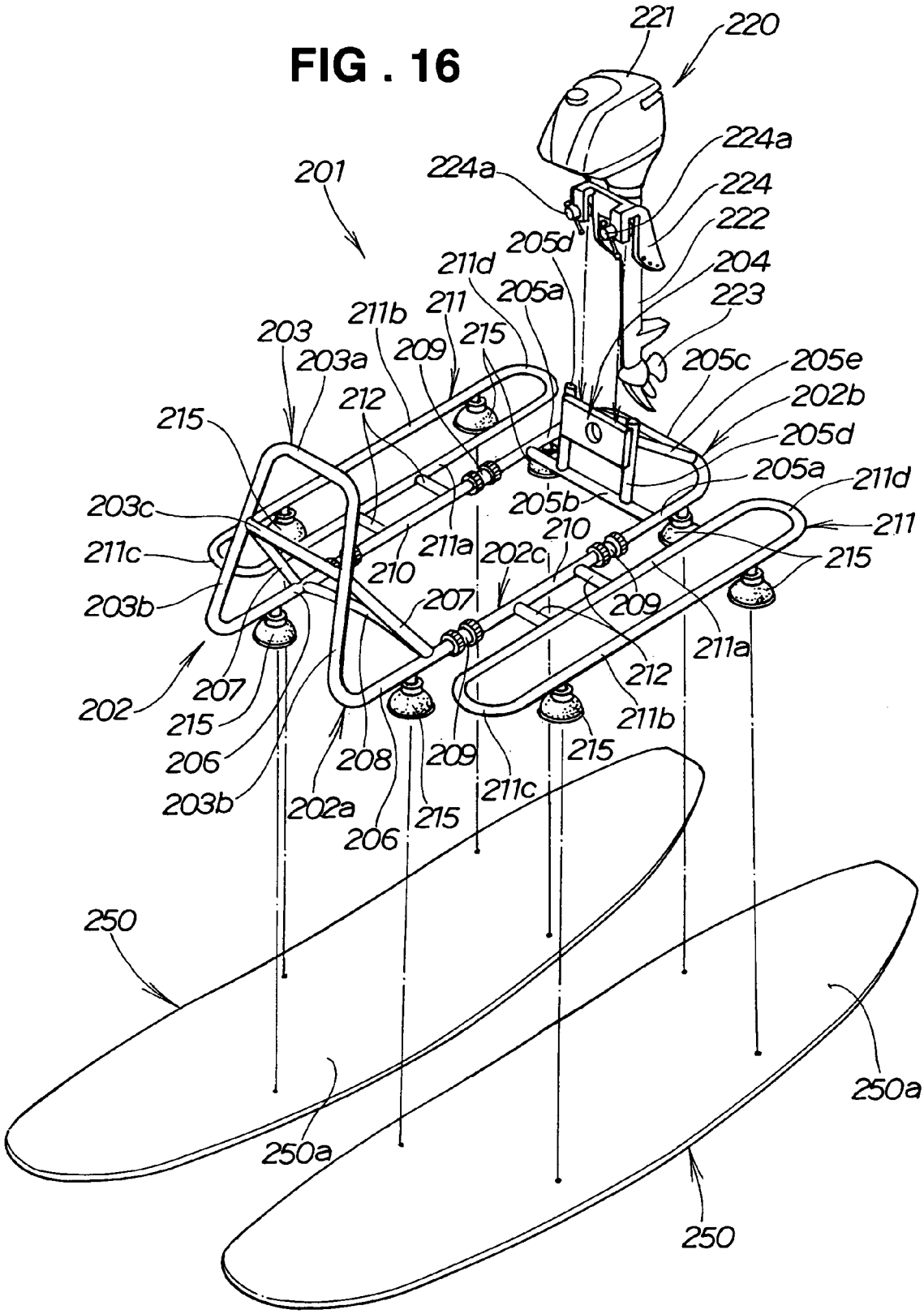
FIG. 16 is an exploded perspective view of a marine propulsion attachment according to a third embodiment of the present invention, including a frame structure designed for attachment to two surfboards disposed in parallel.
Figure 17:
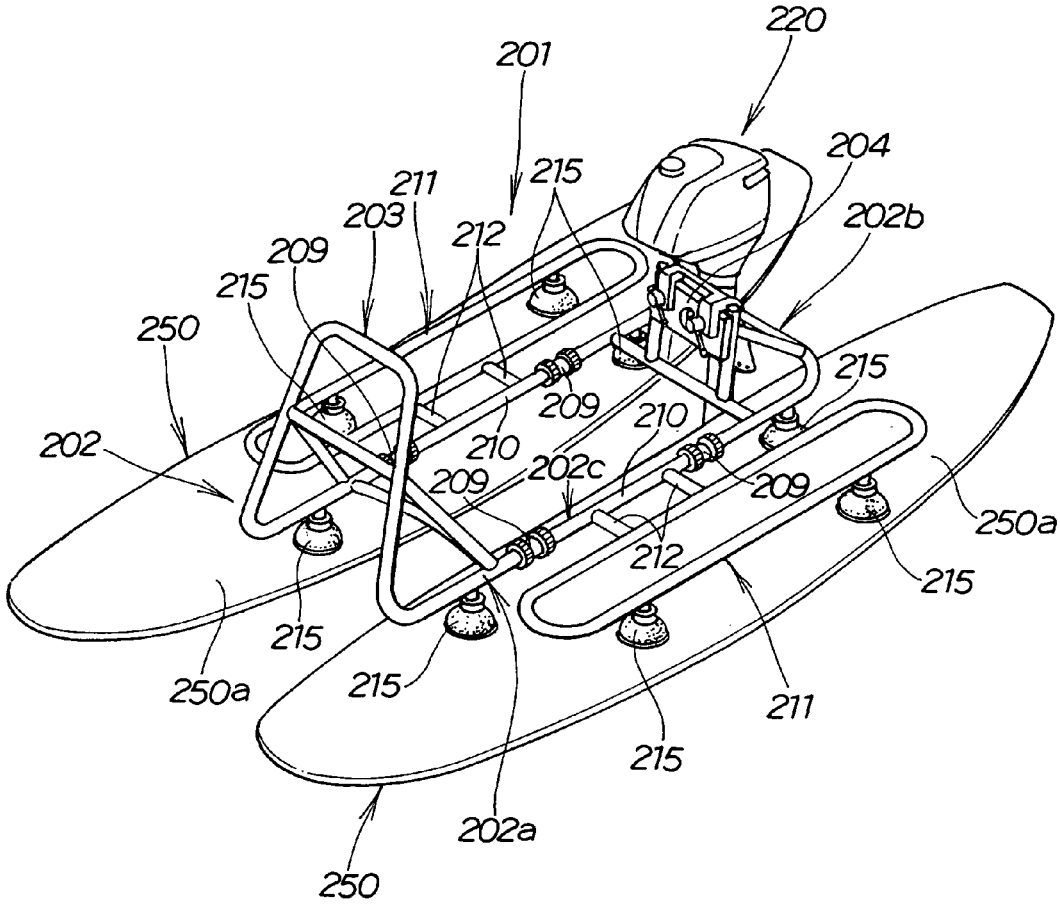
FIG. 17 is a perspective view of the marine propulsion attachment as it is attached to the two surfboards.
Figure 18:
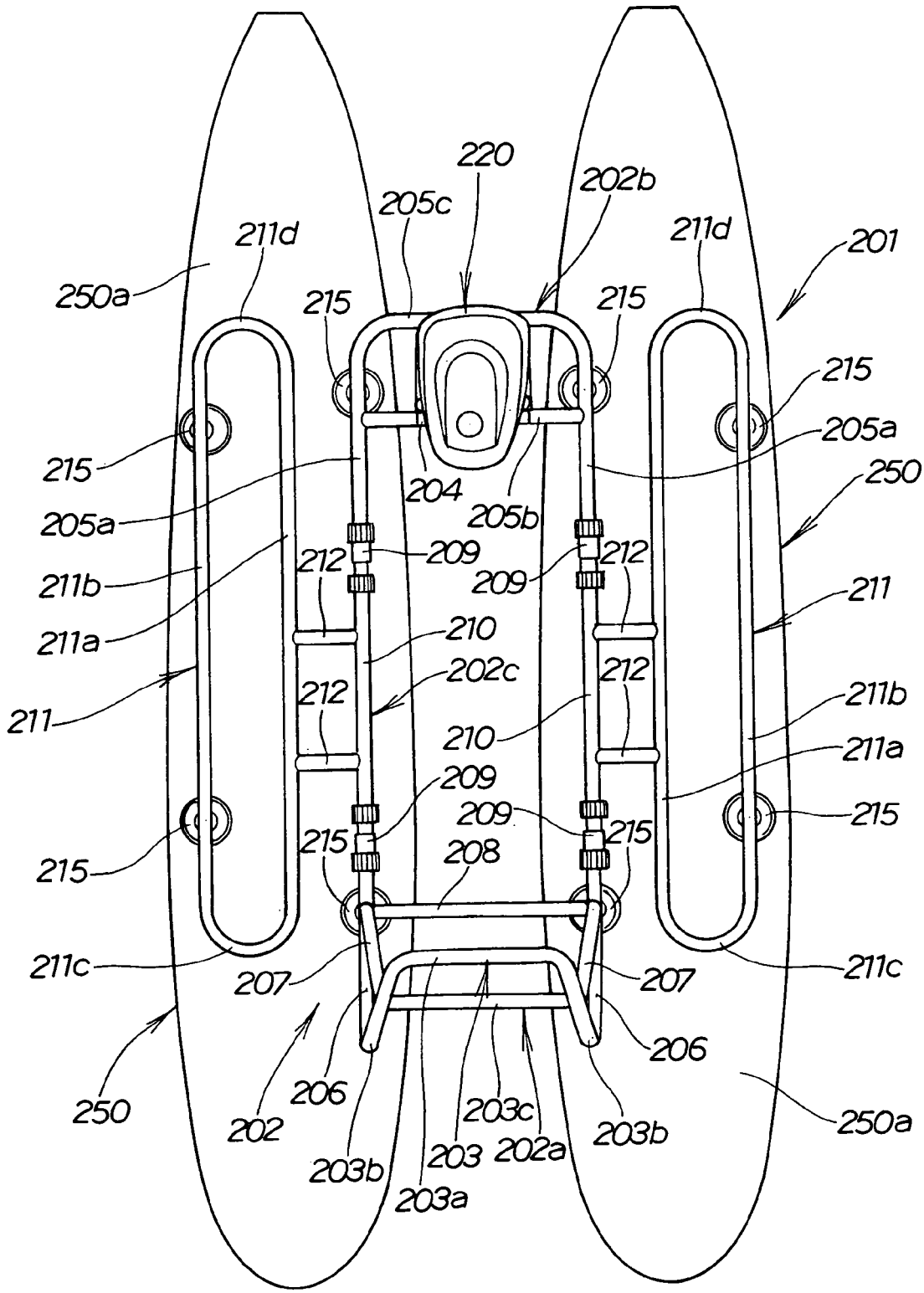
FIG. 18 is a plan view of FIG. 17.
Figure 19:
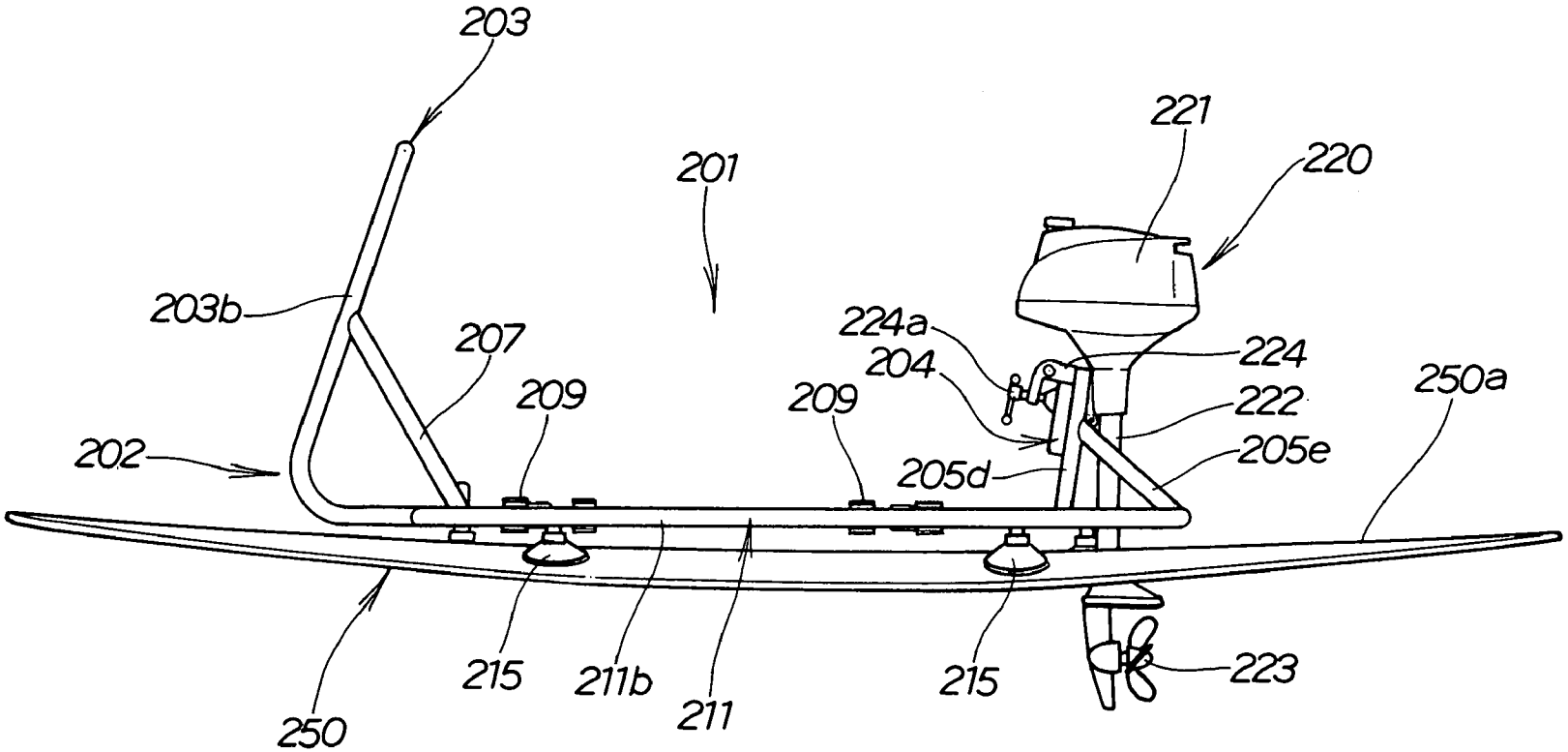
FIG. 19 is a left side view of FIG. 17.
Figure 20:
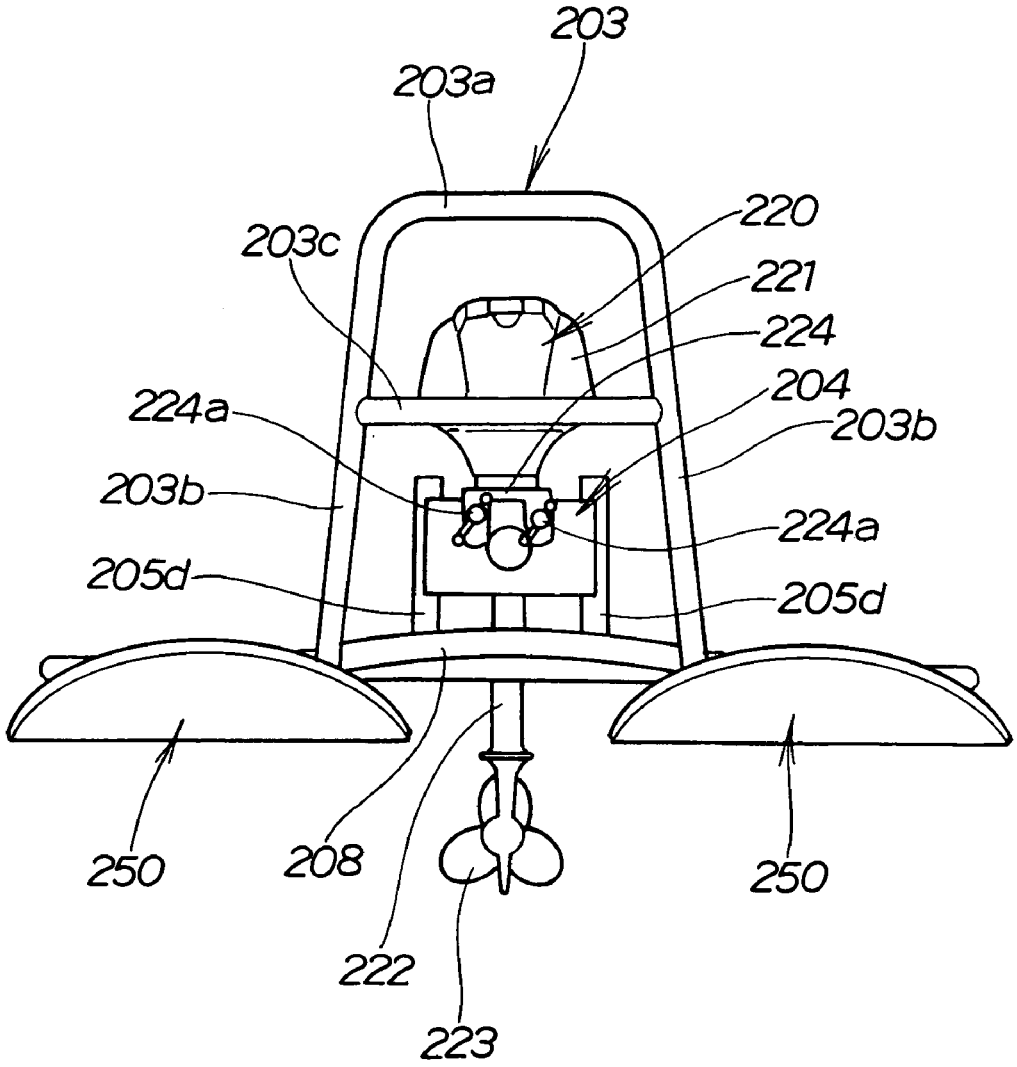
FIG. 20 is a front view of FIG. 17.

The frame body 202 has a skeleton structure formed of plural pipe members connected together. As shown in FIGS. 16–18, the generally elongated ladder-like frame body 202 of skeleton structure has a front part 202*a* including the handle 203, a rear part 202*b* including the transom board 204, and a central part 202*c* disposed between the front and rear parts 202*a* and 202*b*. The front part 202*a* and the central part 202*c* are removably connected together by two coupling devices 209, 209, and the central part 202*c* and the rear part 202*b* are removably connected together by two coupling devices 209, 209. With this construction, the frame body 202 can be separated or disassembled into three parts (i.e., the front, rear and central parts 202*a*, 202*b* and 202*c*) and such separable structure is particularly advantageous in terms of storage and transportation of the frame structure 1.

The front part 202*a* of the frame body 202 has a pair of parallel spaced front side members 206, 206, and a cross member 208 extending between respective rear end portions of the front side members 206, 206. The cross member 208 has a slightly upwardly bent or arcuate configuration. The handle 203 has an inverted U-shape configuration including a horizontal head 203*a* and a pair of vertical stems 203*b*, 203*b* extending downward from opposite ends of the horizontal head 203*a* and blended at lower ends thereof with respective front ends of the front side members 206, 206. The horizontal head 203*a* of the handle 203 forms a grip portion of the handle 203 for gripping by the person riding on the surfboards 250. The handle 203 includes a cross member 203*c* disposed below the horizontal head or grip portion 203*a* and extending between respective intermediate portions of the vertical stems 203*b*, 203*b*. The handle 203 is slightly inclined backward and is supported by a pair of reinforcement members 207, 207 extending between the rear end portions of the front side members 206, 206 and the intermediate portions of the vertical stems 203*b*, 203*b*.

The front part 202*a* of the frame body 202 is provided with two suction cups 215, 215 each mounted on one of the front side members 206, 206 at a position directly below the junction between the cross member 208 and each front side member 206.

The rear part 202*b* of the frame body 202 has a generally U-shaped configuration and includes a pair of parallel spaced rear side members 205*a*, 205*a* connected at rear ends by a cross member 205*c*. The rear part 202*b* also includes a front cross member 205*b* disposed forwardly of the cross member (rear cross member) 205*c* and extending between respective open front end portions of the rear side members 205*a*, 205*a*. The front cross member 205*b* has a rectilinear configuration. A pair of parallel spaced support members 205*d* is disposed upright from the front cross member 205*b* for supporting thereon the transom board 204. The support members 205*d* are reinforced by a pair of reinforcement members 205*e*, 205*e* extending between upper end portions of the support members 205*d* and the rear cross member 205*c*.

The rear part 202*b* of the frame body 202 is provided with two suction cups 215, 215 each mounted on one of the rear side members 205*a*, 205*a* at a position located intermediately between the front cross member 205*b* and the rear cross member 205*c*.

The central part 202*c* of the frame body 202 includes a pair of parallel spaced central side members 210, 210. The central side members 210, 210 each have a front end removably connected by one coupling device 209 to the rear end of the corresponding front side member 206, and a rear end removably connected by the other one coupling device 209 to the front end of the corresponding rear side member 205*a*.

Figure 21:
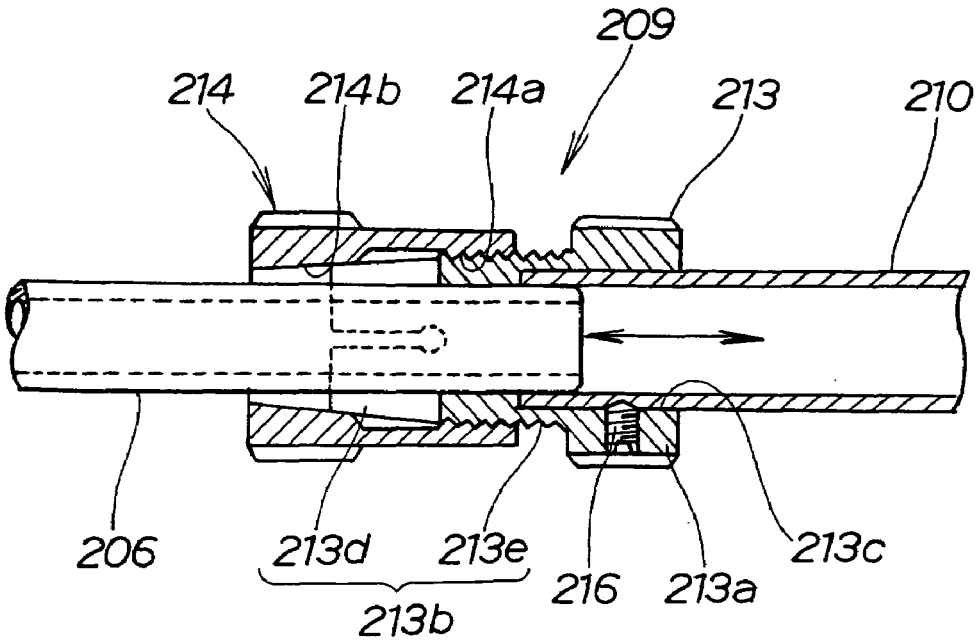
FIG. 21 is an enlarged cross-sectional view of a coupling device used for releasable connection between a front part and a central part of the frame structure.

All of the coupling devices 209 are identical in structure and function. FIG. 21 shows in cross section one of the coupling devices 209, which is used for removably connecting each central cross member 210 and the corresponding front side member 206. In the illustrated embodiment, the central side member 210 has an inside diameter slightly larger than an outside diameter of the front side member 206.

The coupling device 209 is formed by an inner plug member 213 and an outer socket member 214 threadedly engageable with each other. The plug member 213 has an enlarged head 213*a* at one end thereof and a stem 213*b* extending coaxially from the enlarged head 213*a*. The plug member 213 also has a stepped axial central hole 213*c* extending throughout the length of the plug member 213. The stepped axial hole 213*c* has a large-diameter portion (not designated) having a diameter slightly larger than an outside diameter of the central side member 210, and a small-diameter portion (not designated) having a diameter slightly large than the outside diameter of the front side member 206. The stem 213*b* of the plug member 213 has a split tapered tip end portion 213*d* and an externally threaded body portion 213*e* extending between the enlarged head 213*a* and the split tapered tip end portion 213*d*. The plug member 213 is firmly secured to the central side member 210 by a set screw 216 extending radially through the head portion 213*a*. The socket member 214 has an internally threaded hole 214*a* extending from one end to an intermediate portion of the socket member 214 for threaded engagement with the threaded body portion 213*e* of the plug member 213, and a tapered hole 214*b* extending contiguously from an inner end of the threaded hole 214*a* to the other end of the socket member 214 for sliding engagement with the split tapered tip end portion 213*d* of the plug member 213.

In order to connect the front side member 206 and the central side member 210 together, the front end of the central side member 210 is inserted in the large-diameter portion of the stepped axial hole 213*c* of the plug member 213, and the set screw 216 is tightened to secure the plug member 213 to the front end of the central side member 210. Then, the socket member 214 is loosely fitted around the rear end portion of the front side member 206, and the rear end portion of the front side member 206 is inserted into the small-diameter portion of the stepped axial hole 213*c* of the plug member 213. Thereafter, the socket member 214 is placed over the split tapered tip end portion 213*d* of the stem 213*b* of the plug member 215 and by rotating the socket member 214 in a screw tightening direction, the threaded hole 213*e* of the socket member 214 comes in threaded engagement with the threaded body portion 213*e* of the stem 213*b* of the plug member 213. Continued rotation of the socket member 214 causes the socket member 214 to advance toward the head 213*a* of the plug member 213. During that time, a circumferential surface of the tapered hole 214*d* of the socket member 214 forces the split tapered tip end portion 213*d* of the plug member 213 to resiliently displace in a radial inward direction to thereby grip the rear end portion of the front side member 206. The front and central side members 206, 210 are thus connected together by the coupling device 209.

When the front and central side members 206, 210 are to be separated from one another, the socket member 214 is rotated in a screw loosening direction. This will allow the split tapered tip end portion 213*d* of the plug member 213 to spring back in a radial outward direction to restore its original shape. The front side member 206 now can be removed from the stepped axial hole 213*a* of the plug member 213. As will be understood from FIG. 21, the front side member 206 is telescopically movable into and out from the central side member 210, so that the overall length of the frame structure 201 (FIG. 16) can be changed.

Referring back to FIG. 16, the frame structure 201 further includes a pair of auxiliary frames 211, 211 of elongated hollow rectangular shape disposed outside the frame body 202 and extending alongside opposite longitudinal sides of the frame body 202. Each of the auxiliary frames 211 has an inner side member 211*a* connected by connecting members 212 to a respective one of the central side members 210, an outer side member 211*b* extending parallel to the inner side member 211*a* and connected to the inner side member 211 by outwardly curved front and rear cross members 211*c* and 211*d* at front and rear ends of the elongated auxiliary frame 211. The auxiliary frame 211 is provided with two suction cups 215 each mounted on the same outer side member 211*b* at a position located near cross member 211*c* or the rear cross member 211*d*. The suction cups 215 have the same structure as the suction cup 15 described previously with reference to FIG. 4.

The frame structure 201 of the foregoing construction is placed on the two parallel spaced surfboards 250 so that the suction cups 215 contact top surfaces 250*a* of the surfboards 250. By forcing the frame structure 201 downward, a partial vacuum is created in each of the suction cups 215, which tends to hold the suction cup 215 in place. The frame structure 201 is thus attached to the surfboards 250, as shown in FIGS. 17–20.

As shown in FIG. 16, the propulsion unit 220 comprises an outboard motor having an engine cover 221, an extension case 222 extending downward from a lower end of the engine cover 221, a screw propeller 223 at a lower end of the outboard motor 220, and a stern bracket 224 provided for attachment of the outboard motor 220 to the transom board 204. The stern bracket 224 has a hook-like configuration. For attachment, the stern bracket 224 is hooked on the transom board 204 and firmly secured to the transom board 204 by clamp screws 224*a*, 224*a*. The outboard motor 220 is thus attached to the transom board 204 of the frame structure 201, as shown in FIGS. 17–20.

As is well known, the outboard motor 220 includes an engine disposed inside the engine cover 221, a drive shaft received inside the extension case 222, and a gear box disposed in front of the screw propeller 223. The outboard motor 220 is mounted to undergo swivel movement about a vertical axis for steering the surfboards 250 and also undergo pivotal movement about a horizontal axis between a vertical operating position (FIG. 19) and a tilt-up standby position.

The connecting members 212 may have a two-piece structure composed of a first connecting member fixed at one end to the central side member 210 of the frame body 202, and a second connecting member fixed at one end to the inner side member 211*a* of the auxiliary frame 211 and slidably fitted in or around a free end portion of the first connecting member. By using the connecting members of two-piece structure, it is possible to adjust a distance between the frame body 202 and the auxiliary frame 211 to a certain extent according to the size of surfboards to which the frame structure 201 is to be attached.

The outboard motor 220, as it is in a vertical operating position, extends vertically through a space defined between the two surfboards 250, 250. The surfboards 250, 250 are connected together by means of the frame structure 201. The surfboards 250 and the marine propulsion attachment including such frame structure 201 jointly form a twin-hulled self-propelled marine vehicle. When sailing on the sea with driving power from the outboard motor 220, the person riding on the marine vehicle can enjoy a different dynamic performance and riding feel or pleasure than as obtained when riding on a normal surfboard or a surfboard driven by a single outboard motor.

Figure 22:
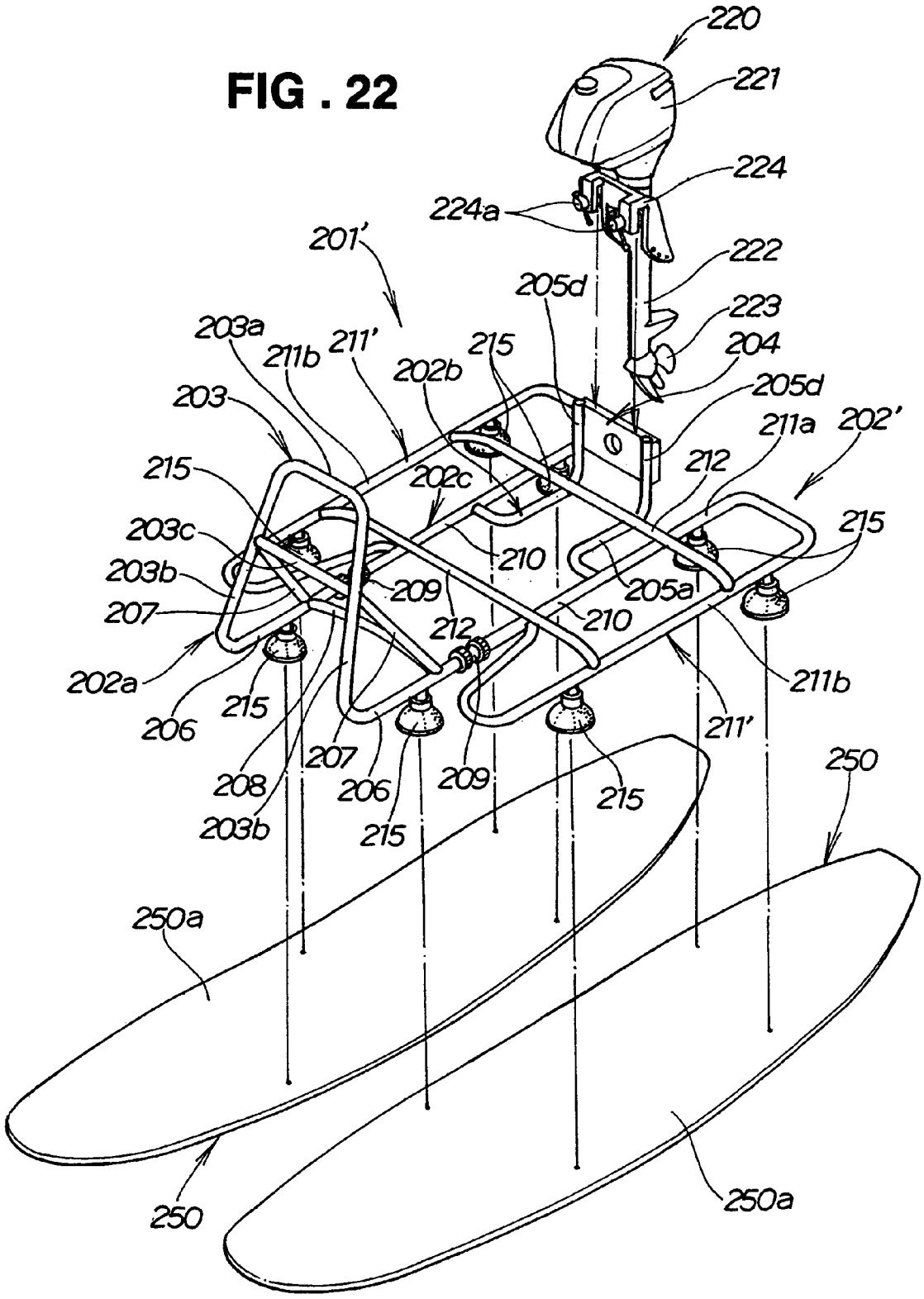
FIG. 22 is a view similar to FIG. 16, but showing a modified marine propulsion attachment according to the present invention.
Figure 23:
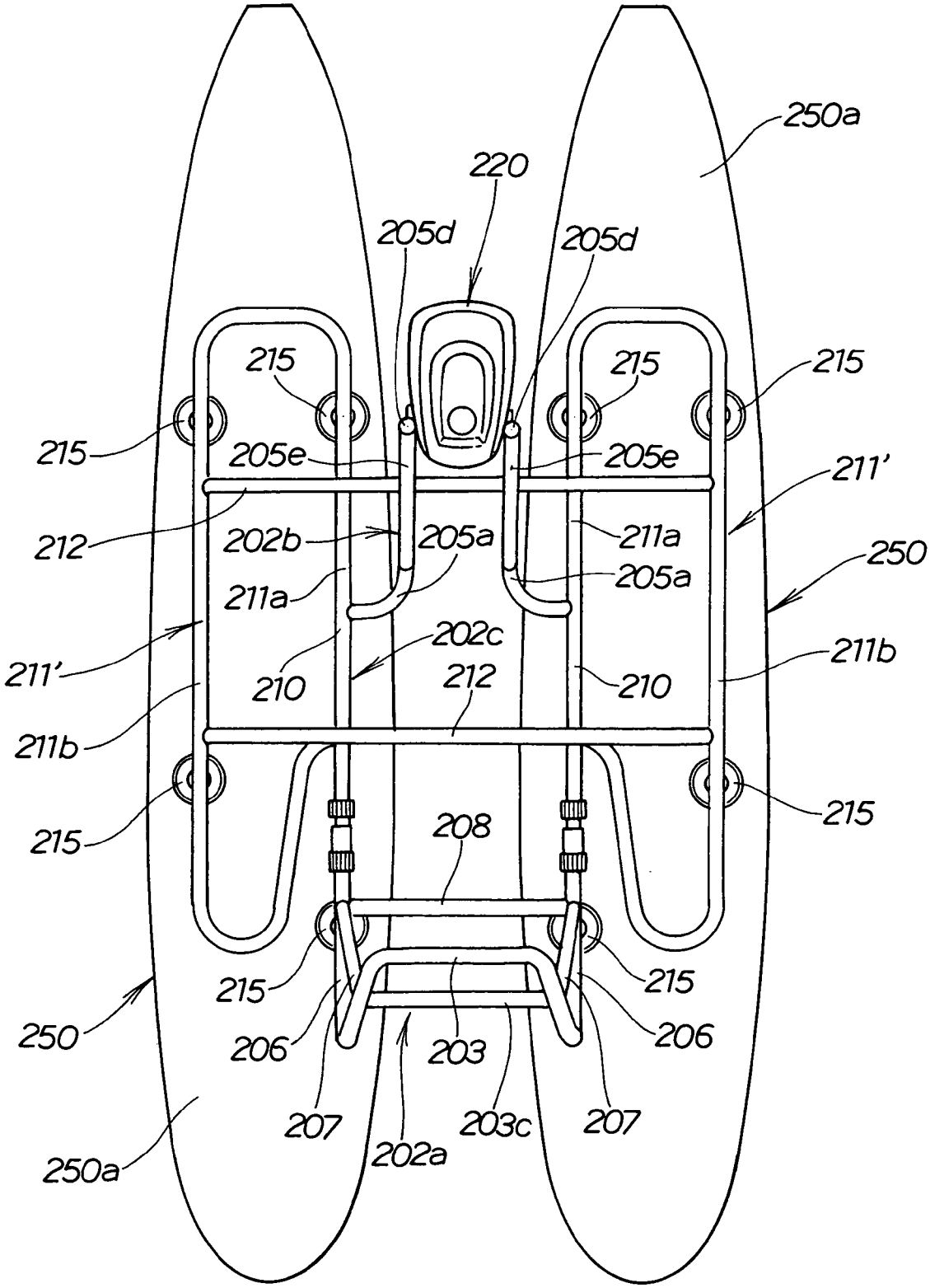
FIG. 23 is a plan view of FIG. 22.
Figure 24:
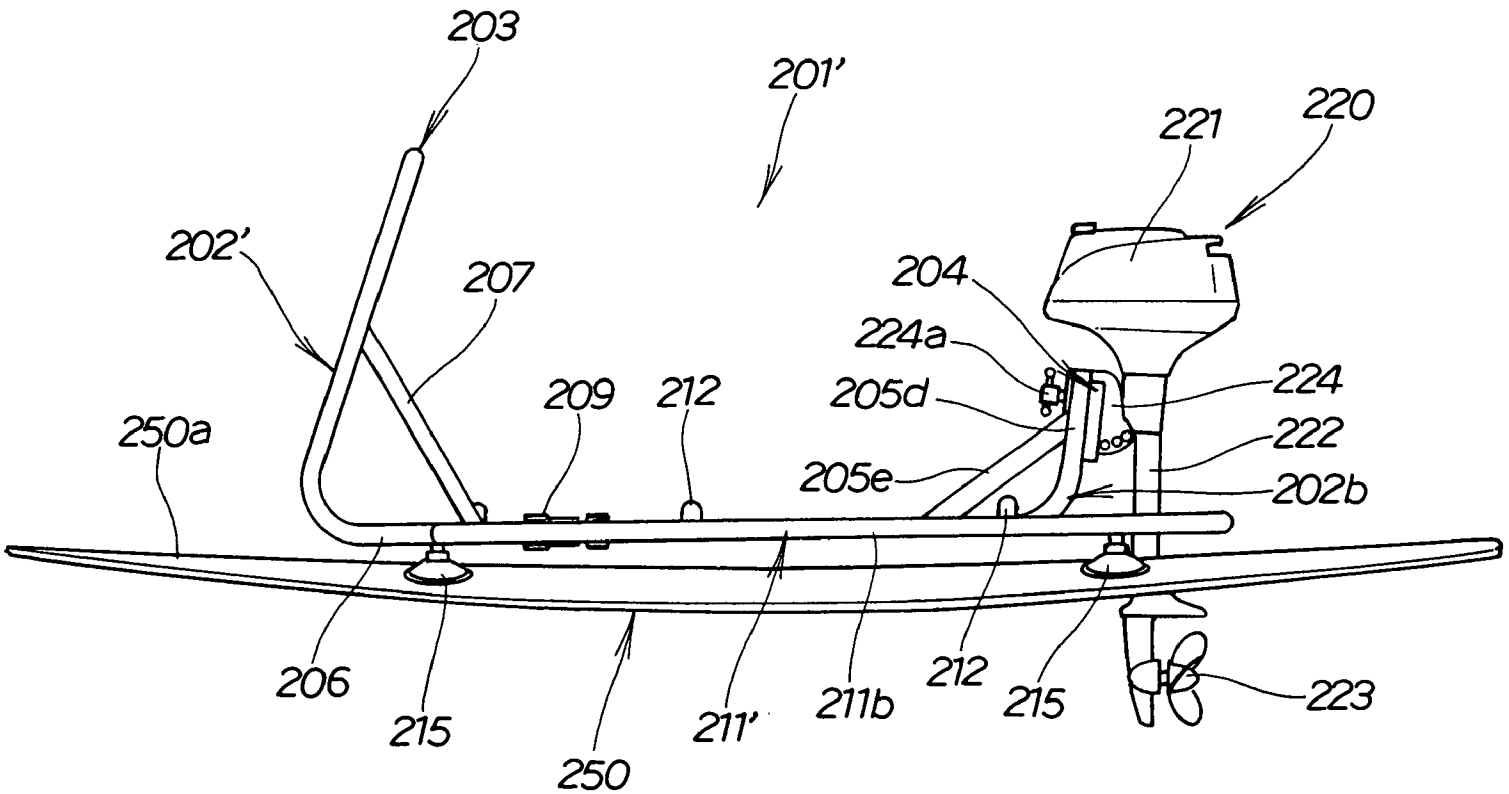
FIG. 24 is a left side view of FIG. 22.

FIGS. 22 to 24 show a modified form of the marine propulsion attachment according to the present invention. The modified marine propulsion attachment is differentiated by the structure of a frame structure 201' from the marine propulsion attachment shown in FIGS. 16–20. The same reference characters designate identical parts throughout the several views and a further description of the identical parts can be omitted. As shown in 22, the modified frame structure 201' includes a frame body 202' and two auxiliary frames 211', 211' disposed one on each side of the frame body 202'. The frame structure 201' has a handle 203 disposed at a front end of the frame body 202', and a transom board 204 disposed at a rear end of the frame body 202'.

The frame body 202' has a skeleton structure formed from pipe members joined together. The frame body 202' includes a front part 202*a* including the handle 203, a rear part 202*b* including the transom board 204, and a central part 202*c* disposed between the front part 202*a* and the rear part 202*b*. The front part 202*a* and the central part 202*c* are removably connected together by two coupling devices 209, 209, so that the frame body 202' can be separated or disassembled into two parts (i.e., the front part 202*a* and a combined central and rear parts 202*c*, 202*b*). This structure is particularly advantageous in terms of storage and transportation of the frame structure 201'.

The front part 202*a* of the frame body 202' is provided with two suction cups 215, 215 each mounted on one of the front side members 206, 206 at a position directly below the junction between the cross member 208 and each front side member 206.

The rear part 202*b* of the frame body 202' is reduced in width and includes a pair of side members 205*a* of generally L-shaped configuration projecting inwardly from a rear end of the central portion 202*c*, a pair of support members 205*d* extending upright from rear ends of the L-shaped side members 205*a* and supporting thereon the transom board 204, and a pair of reinforcement members 205*e*(FIGS. 23 and 24) extending between upper end portions of the support members 205*d* and front end portions of the rear side members 205*a* to reinforce the transom board 204.

The central part 202*c* of the frame body 202' includes a pair of parallel spaced central side members 210, 210. The central side members 210, 210 each have a front end removably connected by one coupling device 209 to the rear end of a corresponding one of the front side members 206. A rear end of each central side member 210 is integrally connected to the front end of the corresponding rear side member 205*a*.

Each of the auxiliary frames 211' has an inner side member 211*a* formed integrally with a respective one of the central side member 210 and extending as a rear end extension of the central side member 210, and an outer side member 211*b* extending parallel with the inner side member 210, the central side member 210 and the front side member 206. The inner and outer side members 211*a* and 211*b* of the auxiliary frame 211' are integrally connected by a cross member (not designated) at a rear end of the auxiliary frame 211'. A front end of the outer side member 211*b* is connected to a longitudinally intermediate portion of the central side member 210 by a generally J-shaped connecting member (not designated). The outer side member 211*b* of one auxiliary frame 211' and the outer side member 211*b* of the other auxiliary frame member 211' are connected together by a pair of connecting members 212, 212. The connecting members 212, 212 are properly spaced in a longitudinal direction of the frame structure 201'.

The auxiliary frames 211' are each provided with three suction cups 215. Two out of the three suction cups 215 are mounted on an underside of the outer side member 211*b* at positions located closer to the front and rear ends than to a longitudinal central portion of the outer side member 211*b*. The remaining suction cup 215 is mounted on an underside of the inner side member 211*a* at a position located near a rear end of the inner side member 211*a*.

The frame structure 201' is attached to the surfboards 250, 250 by means of the suction cups 215 in the same manner as discussed above with respect to the frame structure 201 shown in FIGS. 16–20.

FIGS. 25 to 31 show a rear part 301 of a frame body 300 according to a forth embodiment of the present invention. The rear frame body part 301 is particularly advantageous when used in place of the rear part 2*b* of the frame body 2 according to the first embodiment shown in FIGS. 1–10.

The rear frame body part 301 has a generally ladder-like configuration and preferably formed from a plurality of pipe members connected together. The rear frame body part 301 has a pair of laterally spaced side members 302 and 302 extending in a longitudinal direction of the frame body 300, a front cross member 303 extending transversely between respective front end portions of the side members 302, 302, and a rear cross member 304 extending transversely between respective rear end portions of the side members 302, 302. The side members 302 are bent upwardly at rear ends thereof so as to provide upright support portions 302*a*, 302*a*. A vertical transom board 305 is fixed to the support portions 302*a* for attachment of a propulsion unit (described later) to the frame body 300.

The rear frame body part 301 further includes a support plate 306 disposed astride the side members 302, 302 and extending from a central portion to a rear end portion of the rear frame body part 301, and a pair of generally U-shaped support frames 307, 307 pivotally mounted on the support plate 306 with open ends thereof facing in lateral outward directions of the frame body 300. The U-shaped support frames 307, 307 are arranged symmetrically with each other about a longitudinal centerline of the frame body 300.

The support frames 307 each support one cylindrical float member or pontoon 311 such that a longitudinal axis of the cylindrical pontoon 311 extends parallel to the longitudinal centerline of the frame body 300. The rear frame body part 301 is provided with four suction cups 308. The suction cups 308 are mounted on undersides of the side members 302, 302 at positions located close to junctions between the side members 302, 302 and the front and rear cross members 303, 304.

Figure 26:
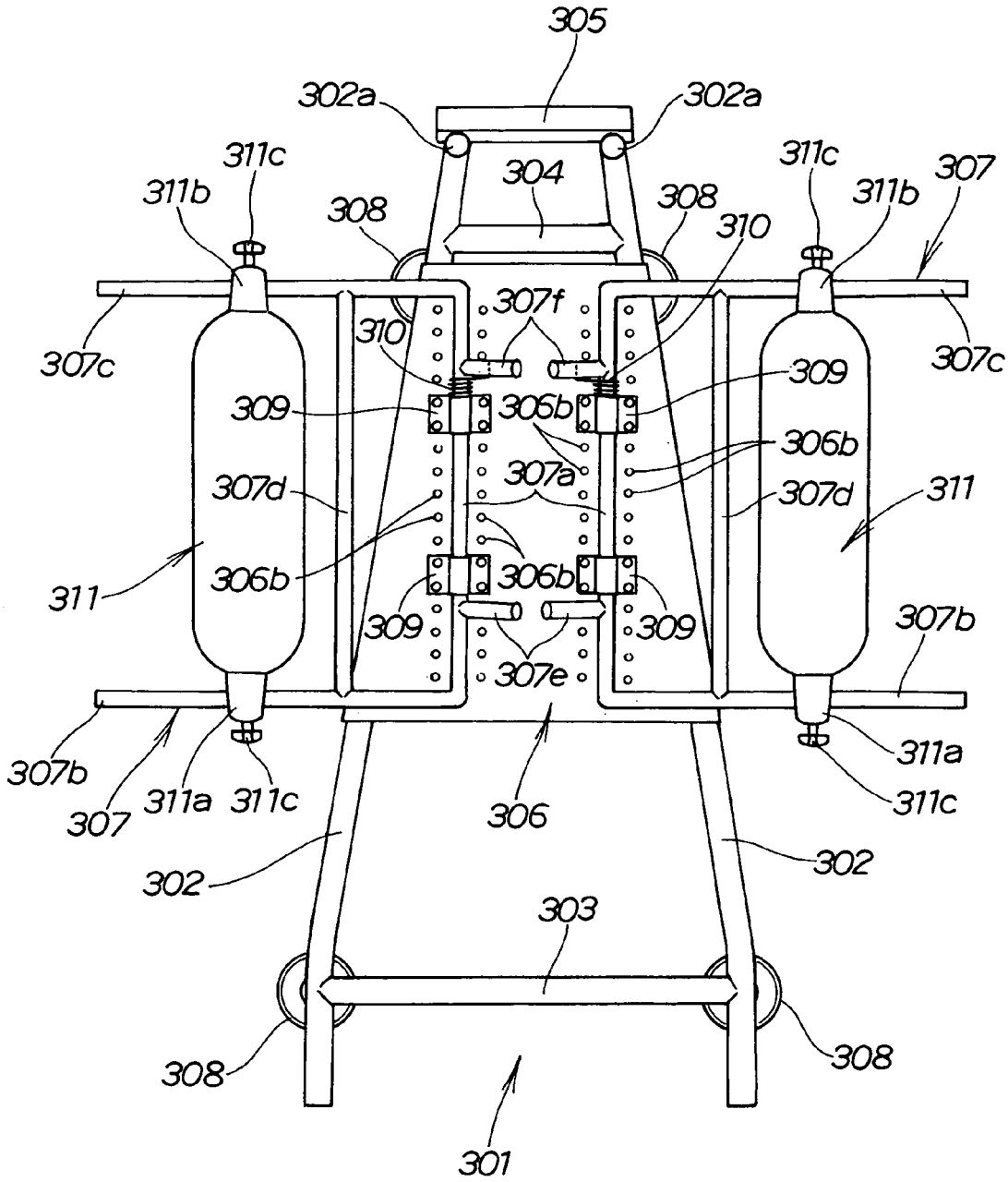
FIG. 26 is a plan view of the rear frame body part of FIG. 25.

As shown in FIG. 26, the rear frame body part 301 of ladder-like configuration has a width gradually reducing in a direction from the front end toward the rear end of the rear frame body part 301. This is because the tail portion of a surfboard 320 (FIGS. 30 and 31) to which the rear frame body part 301 is attached is also tapered. The rear frame body part 301 may have a constant width throughout the length thereof. The front cross member 303 has an upwardly bent or arcuate configuration, and the rear cross member 304 has a rectilinear configuration. The support plate 306 is opposite side edges 306*a* bent downward and connected by welding, for example, to the side members 302.

As shown in FIG. 26, the U-shaped support frames 307 are formed from a pipe and each have a longitudinal base 307*a* forming the bottom of the U-shaped configuration, and a pair of transverse arms 307*b* and 307*c* extending from opposite ends (front and rear ends) of the longitudinal base 307*a*. The support frame 307 further has a cross member 307*d* disposed between the longitudinal base 307*a* and the pontoon 311 and extending between the front transverse arm 307*b* and the rear transverse arm 307*c*.

The longitudinal base 307*a* of the U-shaped support frame 307 is pivotally connected to the support plate 306 by means of a pair of brackets 309, 309. The support frame 307 as a whole is pivotally movable about an axis of the longitudinal base 307*a* with the pontoon 311 supported on the support frame 307. Thus, the pivotal support frame 307 forms an essential part of s a pivot mechanism for allowing vertical movement of the pontoon 311 in response to tilting of the surfboard 320. The pivotal movement of the support frame 307 is limited within a given range. To this end, the support frame 370 has a pair of stopper legs 307*f* extending obliquely upward from the longitudinal base 307*a* of the support frame 307 at an angle relative to the support plate 306 when the support frame 307 is disposed in a normal horizontal position shown in FIGS. 24 and 30. As better shown in FIG. 29, each of the stopper legs 307*f* is disposed near a respective one of the brackets 309. A torsion coil spring 310 is mounted on the longitudinal base 307*a* of the support frame 307 and has one end 310*a* engaged with the stopper leg 307*f* and the other end 310*b* engaged with the bracket 309. With the torsion spring 310 thus arranged, the support frame 307 is urged to assume its horizontal position lying flat over the support plate 306. The angle of inclination of the stopper leg 307*f* determines the range of pivotal movement of the support frame 307 and the pontoon 311 mounted thereon.

Figure 30:
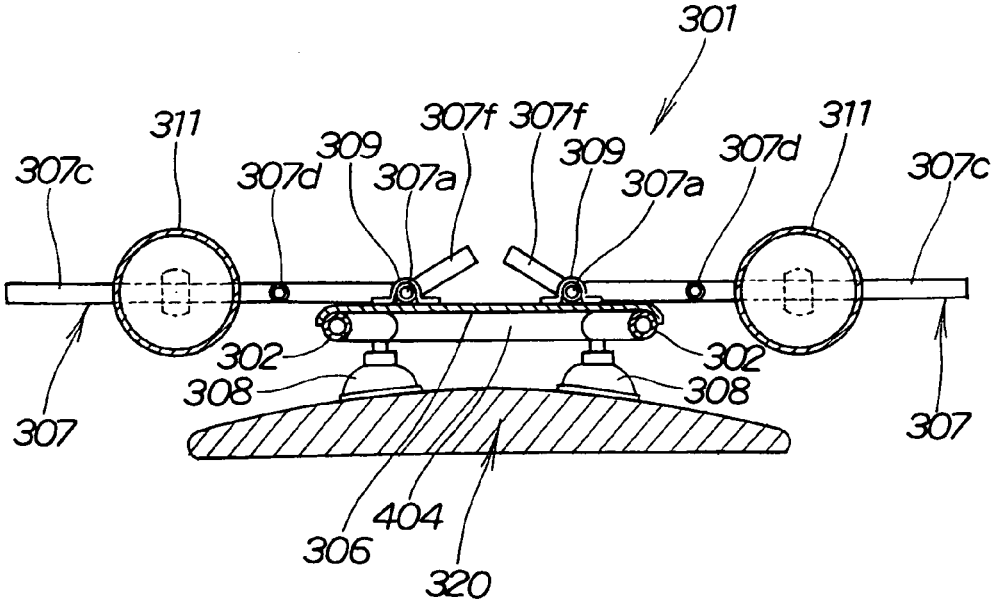
FIG. 30 is a transverse cross-sectional view showing the support frames as they are disposed in a normal horizontal position.
Figure 31:
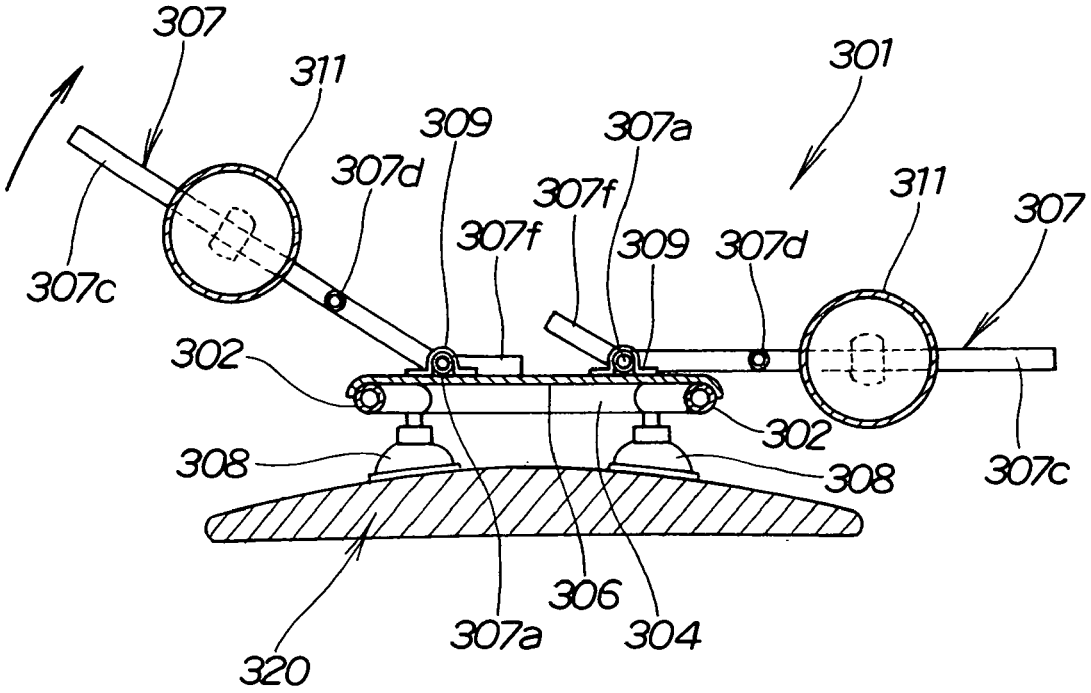
FIG. 31 is a view similar to FIG. 30, but showing one support frame as it is in a tilt-up position.

Each of the support frames 307 is pivotally movable between the normal horizontal position shown in FIG. 30 where the stopper leg 307*f* is separated from the support plate 306, and a tilt-up position shown in FIG. 31 where the stopper leg 307*f* is in contact with the support plate 306.

Figure 25:
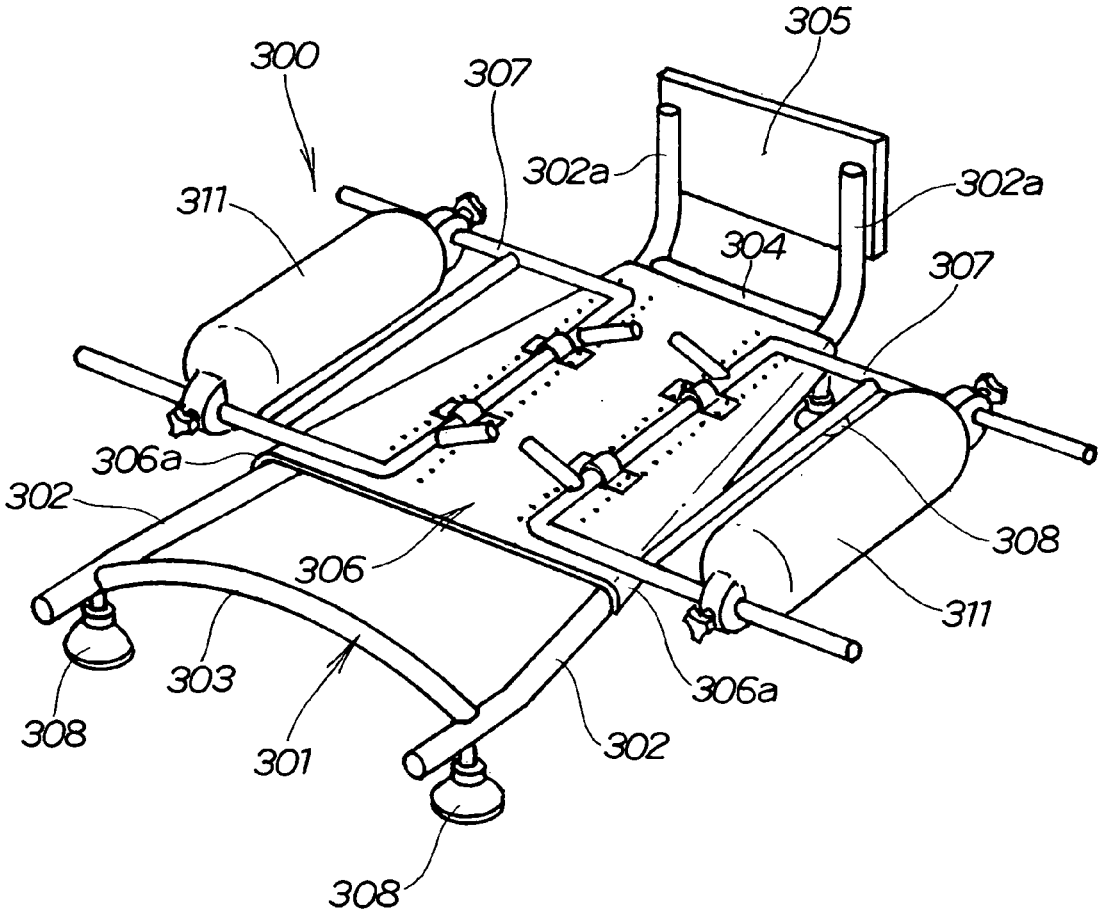
FIG. 25 is a perspective view showing a rear part of a frame body according to a fourth embodiment of the present invention.
Figure 27:
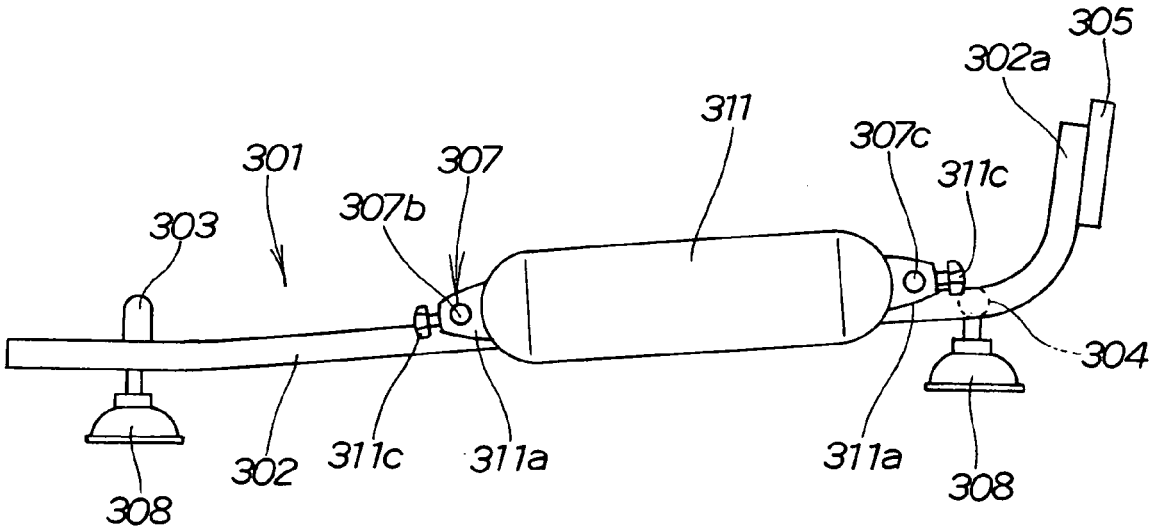
FIG. 27 is a left side view of FIG. 26.
Figure 28:
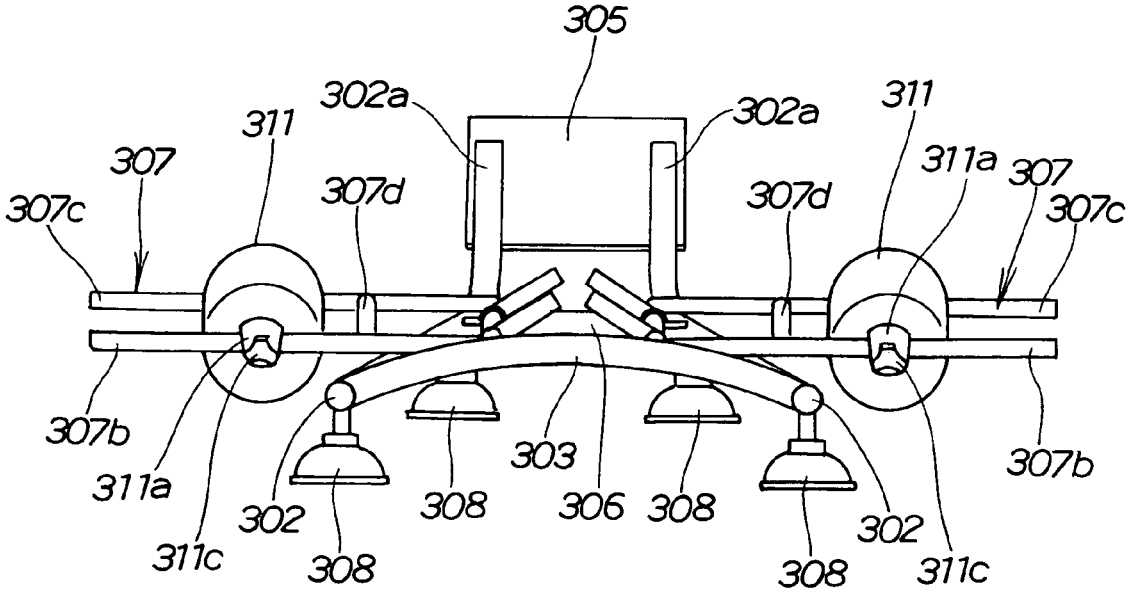
FIG. 28 is a front view of FIG. 26.

As shown in FIG. 26, the support plate 306 has a pair of rows of bracket mounting holes 306*b* formed therein at regular intervals along the longitudinal base 307*a* of each support frame 307. By properly selecting a group of bracket mounting holes 306*b* (four mounting holes in the illustrated embodiment) that are used for attachment of each bracket 309 to the support plate 306, it is possible to change the position of the support frame 307 and the pontoon 311 mounted thereon in the longitudinal direction of the frame body 300 (FIG. 25). As shown in FIGS. 26–28, each cylindrical pontoon 311 has a pair of attachment lugs 311*a*, 311*b* at opposite ends thereof. The attachment lugs 311*a*, 311*b* are slidably mounted on the front and rear transverse arms 307*b*, 307*c* of the support frame 307, respectively. Thus, the pontoon 311 is adjustable in position both in the longitudinal and transverse directions of the frame body 300. The attachment lugs 311*a*, 311*b* each have a clamp screw 311*c* so that when the clamp screw 311*c* is tighten, the associated attachment lug 311*a*, 311*b* is locked in position against displacement relative to the transverse arm 307*b*, 307*c* of the support frame 307. While the clamp screws 311*c* are kept loosened, the pontoon 311 is displaced along the transverse arms 307*b*, 307*c* to a desired position.

The rear part 301 of the frame body 300 is solely placed on a surfboard 320 so that the suction cups 308 contact a top surface of the surfboard 320. The rear frame body part 301 is then forced downward whereupon a partial vacuum is created in each of the suction cups 308. The partial vacuum thus created tends to hold the suction cup 308 in place. The rear frame body part 301 is thus attached to the surfboard 320, as shown in FIG. 33.

Figure 32:
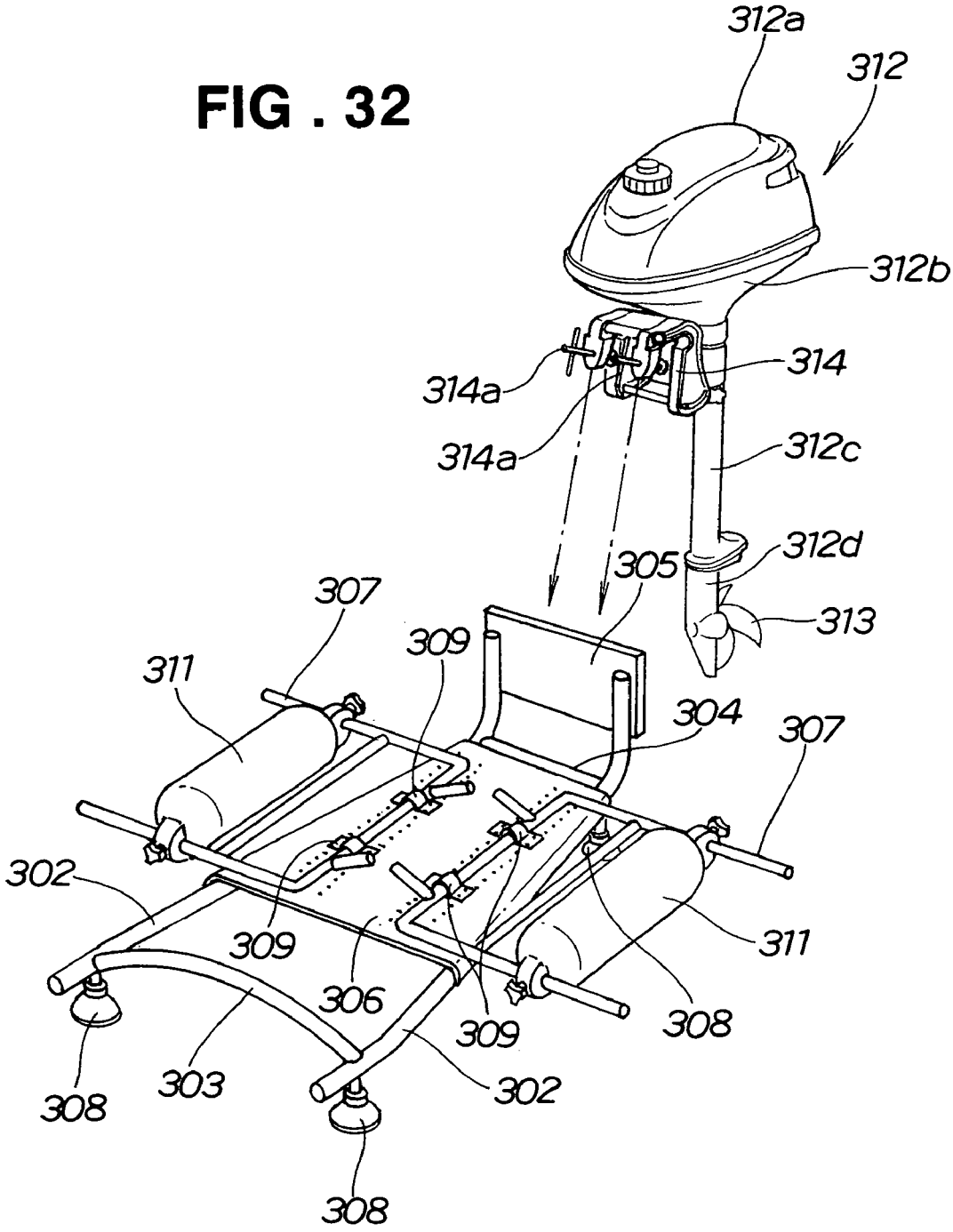
FIG. 32 is a perspective view illustrative of the manner in which an outboard motor is mounted on a transom board of the frame body.

A shown in FIG. 32, the propulsion unit 312 comprises an outboard motor of the type having relatively small engine power. The outboard motor 312 generally includes an engine cover 312*a* and an under cover 312*b* jointly defining an engine room in which an engine, a fuel tank and peripheral devices are installed. The outboard motor 312 also includes an extension case 312*c* extending downwardly from the under cover 312*b*, a gear box 312*d* disposed below the extension cover 312*c*, a screw propeller 313 operatively connected to the gear box 312*d*, and a stern bracket 314 provided for attachment of the outboard motor 312 to the transom board 305. The stern bracket 314 has a hook-like configuration. For attachment, the stern bracket 314 is hooked on the transom board 305 and firmly secured to the transom board 305 by clamp screws 314*a*, 314*a*. As is well known, the outboard motor 312 is mounted to undergo swivel movement about a vertical axis for steering the surfboard 320 (FIG. 33) and also undergo pivotal movement about a horizontal axis between a vertical operating position (FIG. 34) and a tilt-up standby position, not shown.

As described above, the support frames 307 having the pontoons 311 mounted thereon are adjustable in position in a longitudinal direction of the frame body 300. The support frames 307 are pivotally movable about axes of the longitudinal bases 307*a* of the support frames 307. Furthermore, the pontoons 311 are adjustable in position in a transverse direction of the frame body 300.

Figure 33:
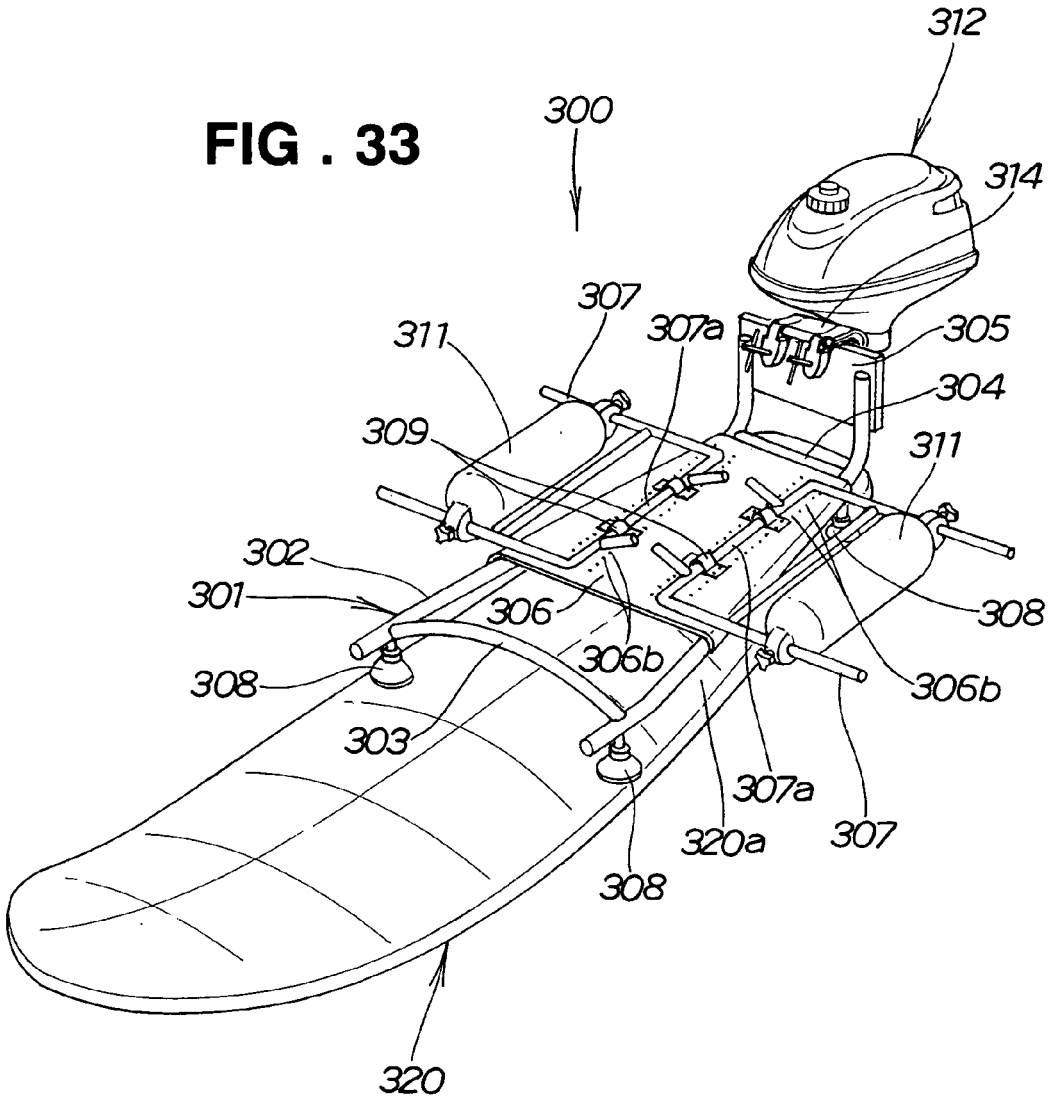
FIG. 33 is a view similar to FIG. 32, but showing the frame body attached to a surfboard with the outboard motor mounted on the transom board.
Figure 34:
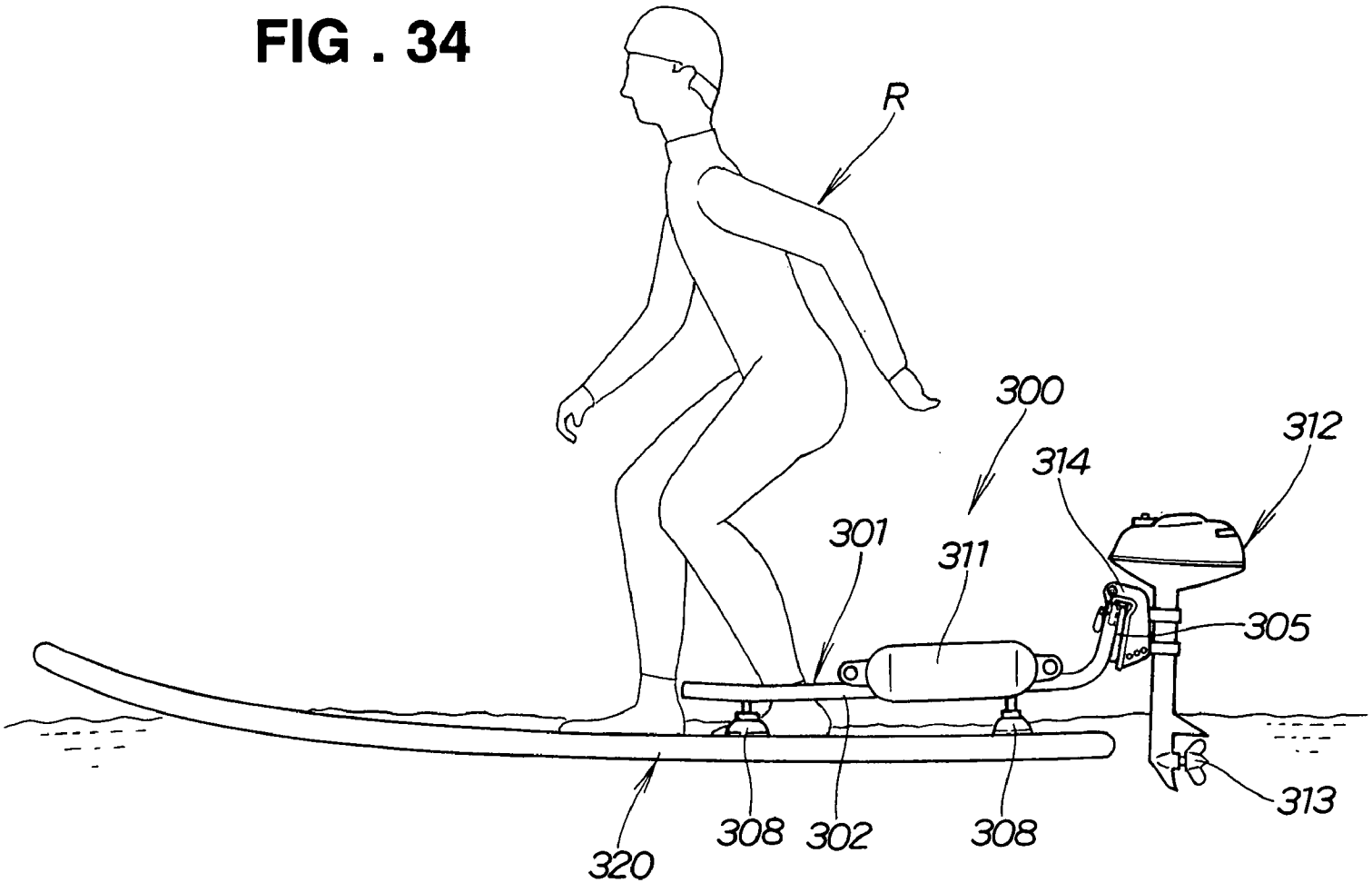
FIG. 34 is a side view showing the surfboard as it is propelled by the outboard motor with a person riding on the self-propelled surfboard.

The surfboard 320 equipped with the outboard motor 312 mounted thereon via the rear frame body part 301, as shown in FIGS. 33 and 34, now constitutes a self-propelled surfboard that can propel with power from the outboard motor 312. The self-propelled surfboard 320 is particularly useful when a surfrider desirous of moving to a nearby surfriding point in the shortest time. The pontoons 311 produce additional buoyancy, which is effective to keep the surfboard 320 stable in position against upsetting during self-propelled sailing of the surfboard 320.

Figure 29:
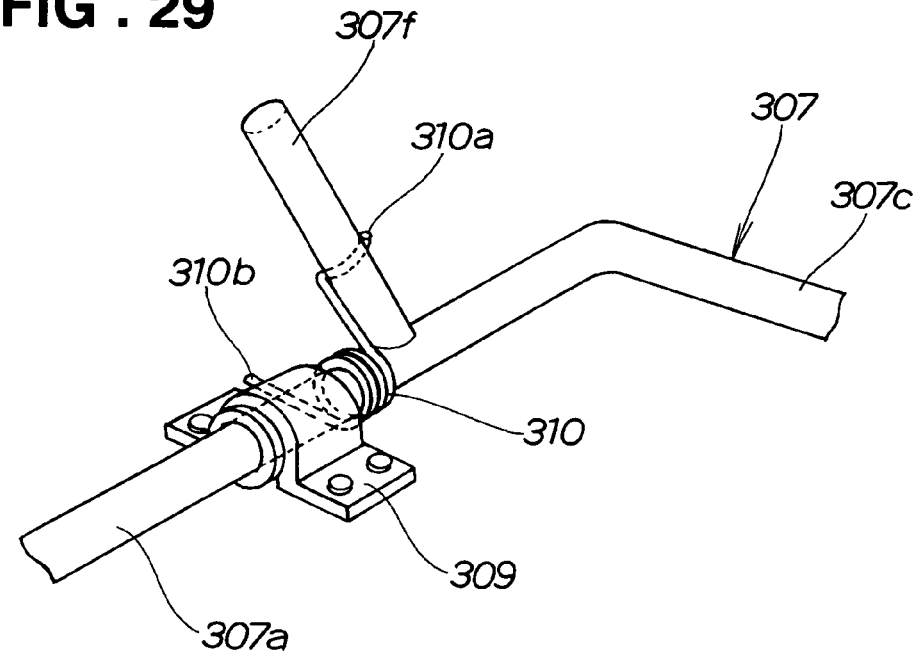
FIG. 29 is a perspective view showing a mechanism for limiting the range of pivotal movement of a support frame and a pontoon mounted thereon.
Figure 35:
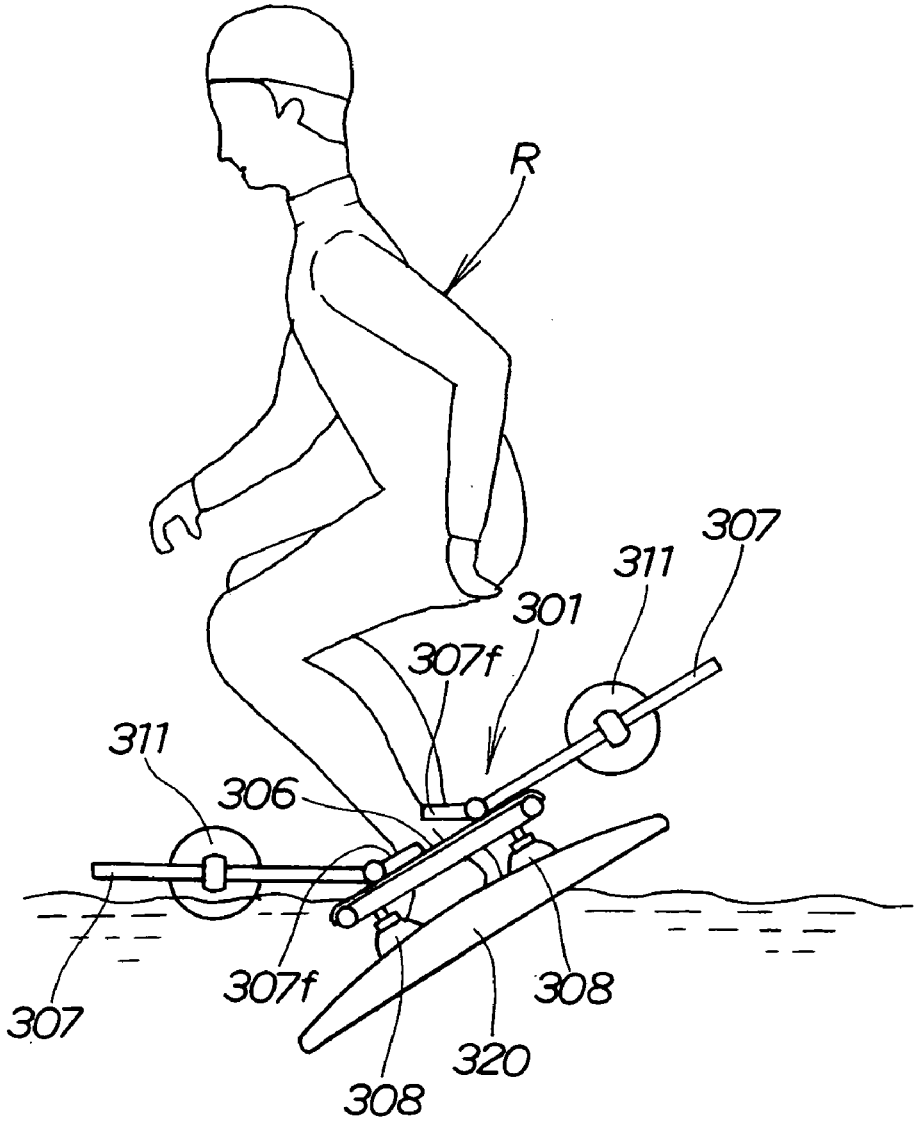
FIG. 35 is a diagrammatical view illustrative of the position of the pontoons occurring when the surfrider tilts the surfboard for steering.

FIG. 35 shows a condition in which the surfboard 320 is tilted in one direction during surfriding. In this instance, since the support frames 307 are pivotally movable relative to the support plate 306, one support frame 307 disposed on the same side as the tilting direction is forced to turn in an upward direction due to the effect of an upward lift or buoyancy acting on the pontoon 311. Upward pivotal movement of the support frame 307 is limited when the stopper leg 307*f* comes in contact with an upper surface of the support plate 306. Since the buoyancy acting on the pontoon 311 becomes larger as the pontoon 311 sinks deeper in the seawater, further tilting of the surfboard does no take place. The other support frame 307 is kept in the normal position lying flat over the support plate 306 by the force of the torsion spring 310 (FIG. 29).

Figure 36:
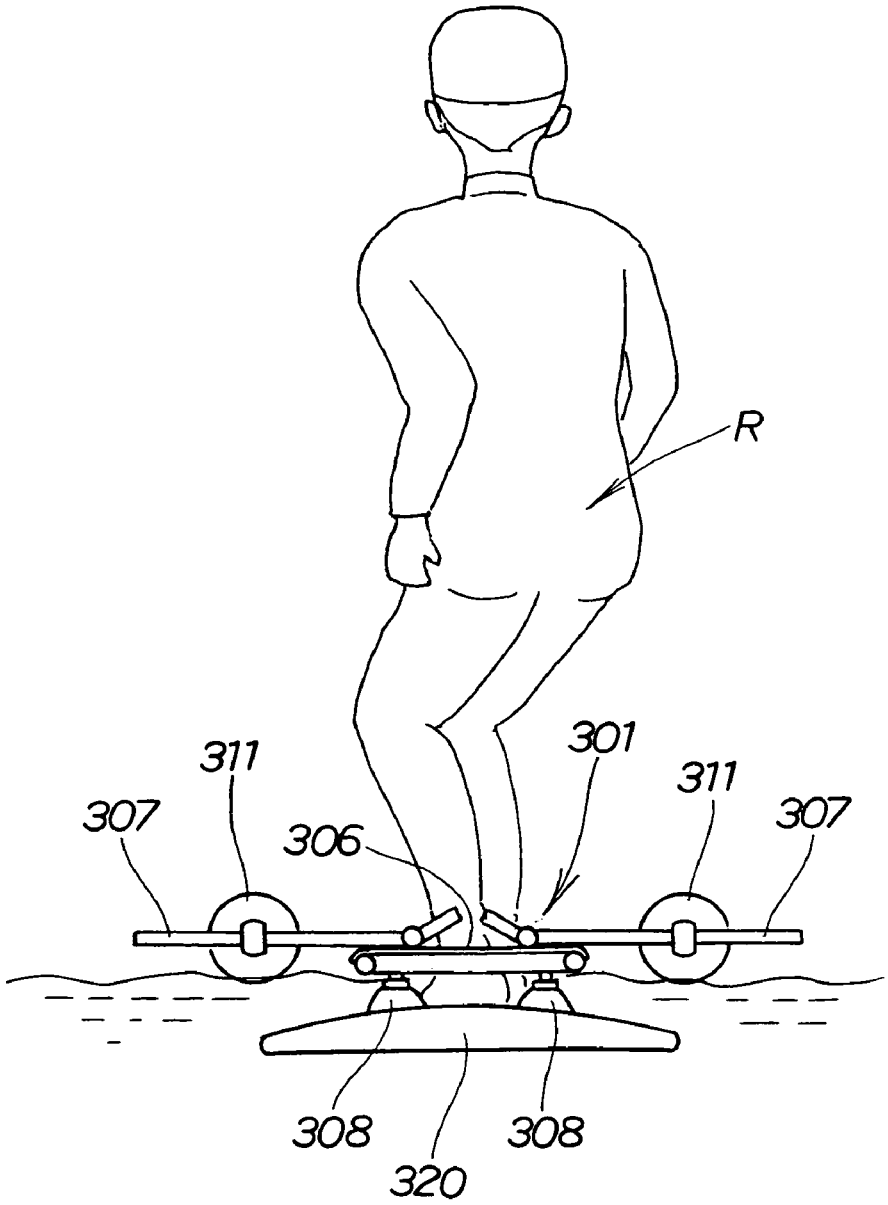
FIG. 36 is a view similar to FIG. 35, but showing the surfboard in a normal floating condition.

FIG. 36 shows a condition in which the surfboard 320 is kept balanced in a substantially horizontal floating position under the effect of upward lifts or buoyancies acting on the respective pontoons 311.

In the embodiments described above, suction cups are used as a means for removably connecting a handle or a frame body including such handle of a frame structure to a non-self-propelled marine vehicle. The invention should by no means be limited to those in the illustrated embodiments but may include any sort of removable connecting means other than the suction cup. For example, when the non-self-propelled marine vehicle comprises a wind-surfboard, an existing latch mechanism essentially provided for anchoring or catching a sail or a mast can be used for removable connection of the frame structure and the wind-surfboard. Furthermore, the outboard motor used in the illustrated embodiment as a propulsion unit can be replaced with a waterjet pump unit.

Obviously, various minor changes and modifications are possible in the light of the above teaching. It is to be understood that within the scope of the appended claims the present invention may be practiced otherwise than as specifically described.

What is claimed is:

1. A frame structure for attachment of a propulsion unit to a non-self-propelled marine vehicle, comprising:

a frame body having a front end and a rear end spaced apart from one another in a lengthwise direction of the frame body;

a handle disposed at the front end of the frame body and having a grip portion extending in a widthwise direction of the frame body for holding by a person riding on the marine vehicle;

a substantially vertical transom board disposed at the rear end of the frame body for attachment of the propulsion unit to the frame structure; and connecting means on the frame body for removably connecting the frame body to the marine vehicle;

wherein the frame body comprises a front part including the handle, a rear part including the transom board, and a central cart disposed between the front part and the rear part, the central part being removably connected to both the front part and the rear part, and the frame body further comprising at least one additional central part having a different length than the central part, the central part and the at least one additional central part being replaceable with one another.

2. A frame structure for attachment of a propulsion unit to a non-self-propelled marine vehicle, comprising:

a frame body having a front end and a rear end spaced apart from one another in a lengthwise direction of the frame body;

a handle disposed at the front end of the frame body and having a grip portion extending in a widthwise direction of the frame body for holding by a person riding on the marine vehicle;

a substantially vertical transom board disposed at the rear end of the frame body for attachment of the propulsion unit to the frame structure; and connecting means on the frame body for removably connecting the frame body to the marine vehicle; the connecting means comprising suction cups mounted to the frame body.

3. A frame structure for attachment of a propulsion unit to a non-self-propelled marine vehicle, comprising:

a frame body having a front end and a rear end spaced apart from one another in a lengthwise direction of the frame body;

a handle disposed at the front end of the frame body and having a grip portion extending in a widthwise direction of the frame body for holding by a person riding on the marine vehicle;

a substantially vertical transom board disposed at the rear end of the frame body for attachment of the propulsion unit to the frame structure; and connecting means on the frame body for removably connecting the frame body to the marine vehicle;

wherein the frame body has a skeleton structure formed of plural pipe members connected together, the frame body of skeleton structure having a front part including the handle, a rear part including the transom board, and a central part disposed between the front part and the rear part, each of the front, rear and central parts having a pair of laterally spaced side members, and wherein the frame body further has a coupling device for removably connecting each of the side members of the central part and a respective one of the side members of at least one of the front part and the rear part of the frame body.

4. A frame structure according to claim 3; wherein each coupling device comprises a hollow cylindrical plug member slidably fitted over and around opposite end portions of the side members of the central and front or rear parts of the frame body, and a hollow cylindrical socket member loosely fitted around one of the opposite end portions of the side members and threadedly engageable with the plug member to form the coupling device, the plug member being firmly secured to the other of the opposite end portions of the side members and having a split tapered end portion, the socket member having a tapered hole for slidably receiving therein the split tapered end portion of the plug member, and wherein when the socket member is turned in a screw tightening direction, an inner circumferential surface of the tapered hole of the socket member forces the split tapered end portion of the plug member to resiliently displace in a radial inward direction to thereby grip the one of the opposite end portions of the side members.

5. A removable marine propulsion attachment for a non-self-propelled marine vehicle, comprising:

a frame structure including a frame body having a front end and a rear end spaced apart from one another in a lengthwise direction of the frame body, a handle disposed at the front end of the frame body and having a grip portion extending in a widthwise direction of the frame body for holding by a person riding on the marine vehicle, a substantially vertical transom board disposed at the rear end of the frame body, and connecting means on the frame body for removably connecting the frame body to the marine vehicle; and a propulsion unit removably mounted on the transom board of the frame structure;

wherein the frame body comprises a front part including the handle, a rear part including the transom board, and a central part disposed between the front part and the rear part, the central part being removably connected to both the front part and the rear part, and the frame body further comprising at least one additional central part having a different length than the central part, the central part and the at least one additional central part being replaceable with one another.

6. A removable marine propulsion attachment for a non-self-propelled marine vehicle, comprising:

a frame structure including a frame body having a front end and a rear end spaced apart from one another in a lengthwise direction of the frame body, a handle disposed at the front end of the frame body and having a grip portion extending in a widthwise direction of the frame body for holding by a person riding on the marine vehicle, a substantially vertical transom board disposed at the rear end of the frame body, and connecting means on the frame body for removably connecting the frame body to the marine vehicle, the connecting means comprising suction cups mounted to the frame body; and a propulsion unit removably mounted on the transom board of the frame structure.

7. A removable marine propulsion attachment for a non-self-propelled marine vehicle, comprising:

a frame structure including a frame body having a front end and a rear end spaced apart from one another in a lengthwise direction of the frame body, a handle disposed at the front end of the frame body and having a grip Portion extending in a widthwise direction of the frame body for holding by a person riding on the marine vehicle, a substantially vertical transom board disposed at the rear end of the frame body, and connecting means on the frame body for removably connecting the frame body to the marine vehicle; and a propulsion unit removably mounted on the transom board of the frame structure;

wherein the frame body has a skeleton structure formed of plural pipe members connected together, the frame body of skeleton structure having a front part including the handle, a rear part including the transom board, and a central part disposed between the front part and the rear part, each of the front, rear and central parts having a pair of laterally spaced side members, and wherein the frame body further has a coupling device for removably connecting each of the side members of the central part and a respective one of the side members of at least one of the front part and the rear part of the frame body.

8. A removable marine propulsion attachment according to claim 7; wherein each coupling device comprises a hollow cylindrical plug member slidably fitted over and around opposite end portions of the side members of the central and front or rear parts of the frame body, and a hollow cylindrical socket member loosely fitted around one of the opposite end portions of the side members and threadedly engageable with the plug member to form the coupling device, the plug member being firmly secured to the other of the opposite end portions of the side members and having a split tapered end portion, the socket member having a tapered hole for slidably receiving therein the split tapered end portion of the plug member, and wherein when the socket member is turned in a screw tightening direction, an inner circumferential surface of the tapered hole of the socket member forces the split tapered end portion of the plug member to resiliently displace in a radial inward direction to thereby grip the one of the opposite end portions of the side members.

9. A removable handle for a non-self-propelled marine vehicle, comprising:

a handle body having a grip portion at an end thereof for gripping by a person riding on the marine vehicle; and at least one suction cup mounted on an opposite end of the handle body for removably connecting the handle body to a top surface of the marine vehicle;

wherein the handle body has a length sufficient to enable a person riding on the marine vehicle to stand upright thereon while gripping the grip portion when the handle body is removably connected to the top surface of the marine vehicle.

10. A removable handle according to claim 9; wherein the handle body has a generally inverted U shape and, when removably connected to the top surface of the marine vehicle, includes a horizontal head forming the grip portion and a pair of vertical stems extending downwardly from opposite ends of the horizontal head; and a suction cup mounted on a lower end of each of the vertical stems.

11. A frame structure for detachably attaching a propulsion unit to a non-self-propelled marine vehicle, comprising: an elongated frame body having a front end and a rear end spaced apart from one another in a lengthwise direction of the frame body; a transom board connected to the rear end of the frame body for detachable attachment of the propulsion unit to the frame structure; a plurality of connectors for removably connecting the frame body to a top surface of the marine vehicle; and a handle extending upwardly from a front end portion of the frame body and having a grip portion extending widthwise of the frame body for gripping by a person while standing upright on the marine vehicle.

12. A frame structure according to claim 11; wherein the frame body comprises a front part including the handle, a rear part including the transom board, and a central part disposed between the front part and the rear part, the central part and at least one of the front and rear parts of the frame body being removably connected to one another.

13. A frame structure according to claim 12; wherein the central part is removably connected to the front part and the rear part, and the frame body further comprises at least one additional central part having a different length than the central part, the central part and the at least one additional central part being replaceable with one another.

14. A frame structure according to claim 11; wherein the connectors comprise suction cups extending from an underside of the frame body for removable connection to the top surface of the marine vehicle.

15. A frame structure according to claim 11; wherein the frame body comprises a plurality of connected together pipe members.

* * * * *